US009428335B2

(12) United States Patent
Hammond et al.

(10) Patent No.: US 9,428,335 B2
(45) Date of Patent: Aug. 30, 2016

(54) WASTE STORAGE DEVICE

(75) Inventors: Steven Hammond, Cramlington (GB); Scott Rontree, Cramlington (GB); Adam Clarke, Cramlington (GB); Paul Schofield, Cramlington (GB); David Akerman, Cramlington (GB); Nicholas Cudworth, Cramlington (GB); Richard Sharp, Bingley (GB)

(73) Assignee: Sangenic International Limited, Cramlington (GB)

( * ) Notice: Subject to any disclaimer, the term of this patent is extended or adjusted under 35 U.S.C. 154(b) by 0 days.

(21) Appl. No.: 14/002,072

(22) PCT Filed: Feb. 28, 2012

(86) PCT No.: PCT/EP2012/053361

§ 371 (c)(1),
(2), (4) Date: Feb. 10, 2014

(87) PCT Pub. No.: WO2012/116986

PCT Pub. Date: Sep. 7, 2012

(65) Prior Publication Data

US 2014/0183193 A1 Jul. 3, 2014

(30) Foreign Application Priority Data

Feb. 28, 2011 (GB) ..... 1103429.5

(51) Int. Cl.
*B65F 7/00* (2006.01)
*B65F 1/00* (2006.01)
(Continued)

(52) U.S. Cl.
CPC ..... *B65F 7/005* (2013.01); *B65F 1/002* (2013.01); *B65F 1/062* (2013.01); *B65F 1/163* (2013.01); *B65F 1/1615* (2013.01); *B65F 7/00* (2013.01); *B65F 2210/167* (2013.01)

(58) Field of Classification Search
CPC .... B65F 2210/129; B65F 7/005; B65F 7/00; A61L 11/00; A61L 2/23; A61L 2/00
USPC ..... 220/87.1, 87.2
See application file for complete search history.

(56) References Cited

U.S. PATENT DOCUMENTS 412,273 A * 10/1889 Kinney ..... 4/470
577,747 A * 2/1897 Hansen ..... 220/87.1
1,195,034 A * 8/1916 Lang ..... 220/495.08

(Continued)

FOREIGN PATENT DOCUMENTS

AU 644282 B2 12/1993
GB 453291 A 9/1936

(Continued)

OTHER PUBLICATIONS

Elson Silva, PhD, Email sent Jul. 4, 2014, Subject: Protecting Hydrology Science from reinvention by fake Scientists and corrupt Lawyers/Wicking Mob.

(Continued)

*Primary Examiner* — Stephen Castellano
(74) *Attorney, Agent, or Firm* — Nixon Peabody LLP

(57) ABSTRACT

A waste storage device is provided comprising a waste storage compartment for storing waste and a lid. The device further comprises a dispenser for dispensing an agent inside the waste storage device and an actuator arranged to activate the dispenser.

8 Claims, 18 Drawing Sheets

(51) Int. Cl.

| | |
|---|---|
| ***B65F 1/06*** | (2006.01) |
| ***B65F 1/14*** | (2006.01) |

(56) References Cited

U.S. PATENT DOCUMENTS

| | | | |
|---|---|---|---|
| 2,147,139 | A | 2/1939 | Bigman et al. |
| 2,652,173 | A | 9/1953 | Farrell |
| 3,214,065 | A | 10/1965 | Thornton |
| 6,766,817 | B2 | 7/2004 | da Silva |
| 7,396,444 | B2 | 7/2008 | Berndt |
| 7,727,771 | B2 | 6/2010 | Chiou et al. |
| 7,878,359 | B1 | 2/2011 | Ko |
| 8,231,844 | B2 | 7/2012 | Gorfinkel et al. |
| 8,338,187 | B2 | 12/2012 | DeRosier |
| 8,420,024 | B2 | 4/2013 | Korner et al. |
| 8,501,117 | B1 | 8/2013 | Bedair et al. |
| 8,683,867 | B2 | 4/2014 | Ashino |
| 8,733,348 | B2 | 5/2014 | Korneff et al. |
| 8,765,486 | B2 | 7/2014 | DeRosier |
| 2011/0099942 | A1* | 5/2011 | Dunn et al. ..... 53/111 RC |
| 2011/0311876 | A1 | 12/2011 | Sturgeon et al. |
| 2013/0255672 | A1 | 10/2013 | Varga et al. |
| 2013/0284310 | A1 | 10/2013 | Peterson et al. |
| 2013/0327504 | A1 | 12/2013 | Bozorgi et al. |
| 2014/0102134 | A1 | 4/2014 | Daly et al. |

FOREIGN PATENT DOCUMENTS

| | | | |
|---|---|---|---|
| GB | 1105706 | A | 3/1968 |
| GB | 1515266 | A | 6/1978 |
| WO | 9602282 | A1 | 2/1996 |
| WO | 2008059282 | A1 | 5/2008 |
| WO | 2009007723 | A1 | 1/2009 |

OTHER PUBLICATIONS

European Patent Office, International Search Report for Sangenic International Limited PCT/EP2012/053361, mailed Aug. 21, 2012.
European Patent Office, Written Opinion for Sangenic International Limited PCT/EP2012/053361, mailed Aug. 21, 2012.

* cited by examiner

WASTE STORAGE DEVICE

CROSS-REFERENCE TO RELATED APPLICATIONS

This Application is a U.S. National Stage filing under §371 of International Application No. PCT/EP2012/053361, with an international filing date of 28 Feb. 2012, now pending, claiming priority from Great Britain Application No. GB 1103429.5 with a filing date of 28 Feb. 2011, now pending, and herein incorporated by reference.

TECHNICAL FIELD

The invention relates to a waste storage device and cassette.

BACKGROUND

A variety of products are commercially available for depositing and temporarily storing waste, for example used infant nappies or diapers. Many of these products comprise a waste storage device or tub, including a waste storage compartment which can house deposited waste packages, working in conjunction with a waste cassette or cartridge which comprises a plastic bag or tubing. The plastic bag or tubing is used to hold or wrap waste packages inside the waste storage device, to provide a hygienic barrier and to enable the user to empty the waste packages from the waste storage device.

Primary concerns for users of waste storage devices are hygiene and ease of use. Particularly when the waste to be stored is a used infant nappy or diaper, consumers, i.e. parents or carers of the infants, place a high value on ensuring that the waste storage device can be kept clean and odour free. They also want to be confident that the waste cannot escape either whilst it is being stored in the waste storage device or whilst it is being emptied therefrom. Busy parents or carers also need a waste storage system to be straight forward to use and to function reliably. Increasingly, environmental factors are also of concern to consumers, such that it is desirable for a waste storage system to use non-biodegradable materials such as plastic minimally and as efficiently as possible.

An invention is set out in the claims.

According to an aspect there is provided a waste storage device comprising a waste storage compartment for storing waste and a lid. The device further comprises a dispenser for dispensing an agent inside the waste storage device and an actuator arranged to activate the dispenser. The actuator may also actuate opening and/or closing of the lid. Or the actuator may be actuatable when the lid is closed. The agent may have anti-bacterial and/or anti-odour properties. It may be in liquid, gas or powder form.

According to another aspect there is provided a waste storage device comprising a waste storage compartment for storing waste, a lid and a dispenser attachable to said lid. The dispenser comprises a reservoir of liquid, and the device further comprises a wick for dispensing said liquid inside a waste storage device. The liquid may include a fragrance. It may be an oil, such as an essential oil.

According to another aspect there is provided a waste storage device comprising a waste storage compartment for storing waste, a lid and a dispenser attachable to said lid for dispensing an agent inside the waste storage device. When the dispenser is attached to the lid, at least a portion of the dispenser is moveable with respect to the lid. For example, the dispenser may attach to the lid via a screw thread which allows for relative movement between the dispenser and the lid in a direction substantially perpendicular to the plane of the lid.

According to another aspect there is provided a waste cartridge comprising a relatively rigid upper portion and a relatively flexible lower portion, wherein said relatively flexible lower portion is arranged for storing waste items and wherein said relatively rigid upper portion is arranged to be folded about an axis in a direction substantially towards the lower portion of the waste cartridge. The upper portion may comprise a ring or other formation via which the cartridge can be supported or suspended in a waste storage device. The lower portion may comprise a bag or length or tubing for storing waste items. The upper portion may comprise cooperating formations for creating an air tight seal at the top of the bag or flexible tubing when the upper portion is folded.

BRIEF DESCRIPTION OF THE DRAWINGS

Embodiments and examples will now be described with respect to the appended figures of which.

DETAILED DESCRIPTION OF THE INVENTION

In overview there is provided an improved waste storage device and an improved waste cartridge.

The improved waste storage device includes dispensing means for dispensing an antibacterial and/or anti-odour agent inside a waste storage device. The dispenser may be a spray-type dispenser such as an aerosol or may comprise a reservoir of fluid and a wick for distributing the fluid. Alternatively the antibacterial and/or anti-odour agent may be in powder form. An activation means can be provided for activating the dispenser in order to distribute the antibacterial and/or anti-odour agent within a waste storage device. The activation may be linked to actuation of the lid of the waste storage device, including actuation using a foot pedal, or activation of the dispenser may be independent of operation of the lid and other components of the waste storage device.

The dispensing and actuation means are shaped, sized and arranged so as to distribute antibacterial and/or anti-odour agent in a desired area within a waste storage device. For example the agent may be distributed onto a plastic bag or length of flexible tubing extending from a waste storage cassette or cartridge inside the waste storage device, into which a user will place a waste object when the lid of the device is open. It is possible for the dispenser to be moveable within the device to vary the area onto which the agent is distributed. It is also possible to dose the amount of agent distributed within the device at any given time.

The improved waste cartridge comprises a foldable cartridge including a bag for storing waste packages and an upper ring for sealing the top of the bag. The upper ring may also be used to fix the waste cartridge in a waste storage device for use, for example by supporting the ring on or suspending the ring from a formation within the waste storage device. In use, the ring at the top of the bag is folded downwards and the two sides of the ring are pressed, clipped or otherwise sealed together in order to form an airtight waste sack for removal from a waste storage device.

The improved waste storage device and improved waste cartridge may be used in conjunction with one another or with other waste storage products. Both separately and together, they provide a waste storage device system that is straightforward and cost-effective for the user and which improves hygiene and odour prevention as compared to known waste storage systems.

DETAILED DESCRIPTION

Figure 1:
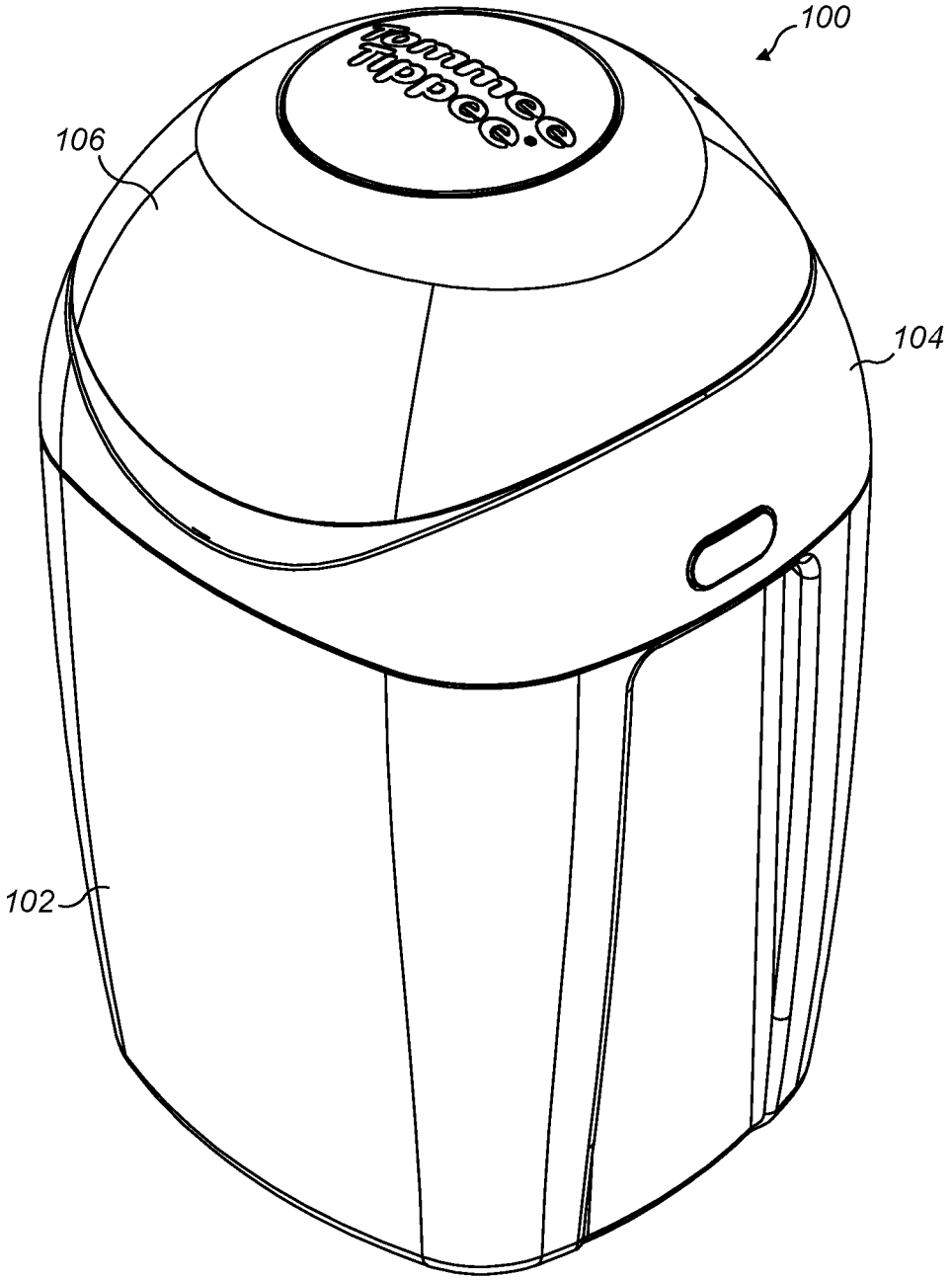
FIG. 1 (Prior Art)
FIG. 1 shows a known waste storage device.

FIG. 1 shows an example of a known waste storage device. This device is described in more detail in International patent application number PCT/GB2007/004410, in the name of Sangenic International Limited, but is shown herein by way of example only. As shown in FIG. 1, the waste storage device 100 comprises a bottom section 102 which includes a waste storage compartment therein, a top section 104 which is removably attachable to the bottom section 102, and a lid 106 for opening and closing the waste storage device 100. As mentioned in the background section above, many different types of waste storage device are known, almost all of which comprise the basic component parts as described herein with respect to FIG. 1.

Figure 2:
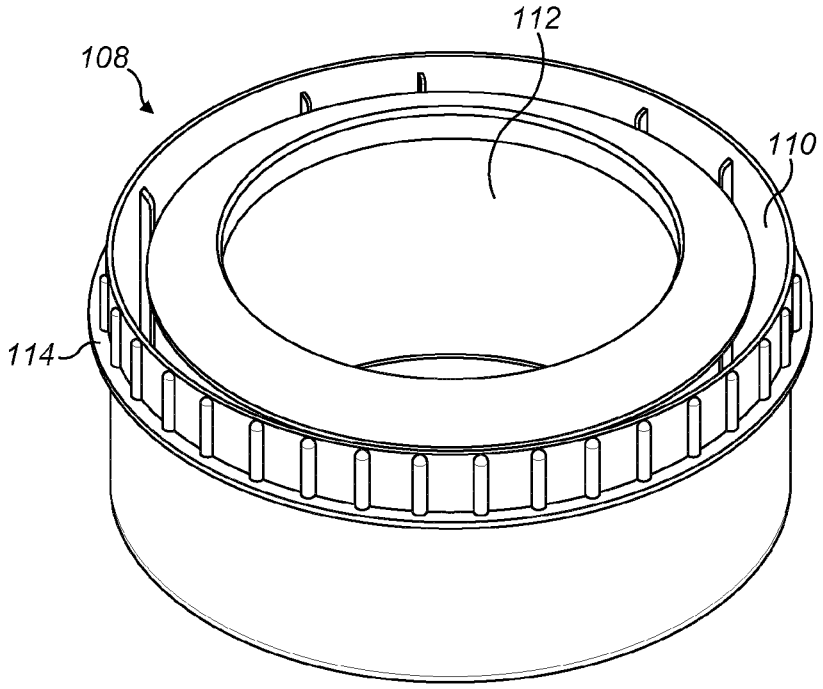
FIG. 2 shows a known waste storage cassette.

FIG. 2 shows an example of a waste storage cassette that can be used in conjunction with a waste storage device. The waste storage cassette shown in FIG. 2 is described in more detail in international patent application number PCT/GB2008/002360, in the name of Sangenic International Limited, but is shown herein by way of example only. As can be seen from FIG. 2, the waste storage cassette 108 comprises inner and outer walls defining a cavity 110 therebetween. The cavity 110 can be used to house plastic bags or tubing for holding and/or wrapping waste packages. The cassette 108 can be placed in the top section 104 of a waste storage device 100. For example, the cassette 108 in FIG. 2 has a flange 114 around its outer wall, by which it can be supported on or suspended in a waste storage device 100. However many other arrangements for housing a waste storage cassette in a waste storage device are known. The inner wall of the cassette 108 in FIG. 2 defines a central core 112. In use, a waste package can be placed in a bag or length of tubing supplied from the cavity 110 of the waste storage cassette 108 and fed through the central core 112 of the cassette 108 through to the waste storage compartment of the waste storage device 100, below the waste storage cassette 108.

As will be known to the skilled person, there are various approaches for wrapping waste packages in a waste storage device working in conjunction with a waste storage cassette. For example, a waste storage cassette or cartridge which supplies flexible tubing for wrapping waste may be rotatable inside a waste storage device, wherein rotation occurs between successive deposits of waste packages so that a twist is formed in the flexible tubing between successive waste packages. This "twist and seal" approach enables discrete waste packages to be wrapped and provides a barrier between the wrapped packages and the central core 112 of the cassette, through which odours or waste material might otherwise escape during use of the waste storage device. Other approaches include providing one or more antechambers between the point at which a waste package is deposited in a waste storage device and the waste storage compartment therebelow. By providing such an antechamber, an airlock can be provided between a user depositing a new waste package and the existing waste packages being stored in the waste storage device. Alternatively or additionally, means may be provided in a waste storage device for masking or neutralising odours created by the waste packages deposited therein. Further alternatively or additionally, means may be provided for distributing anti-bacterial agents in a waste storage device to provide improved hygiene for the user.

Spray Dispenser for Dispensing Anti-Bacterial and/or Anti-Odour Agent

Figure 3:
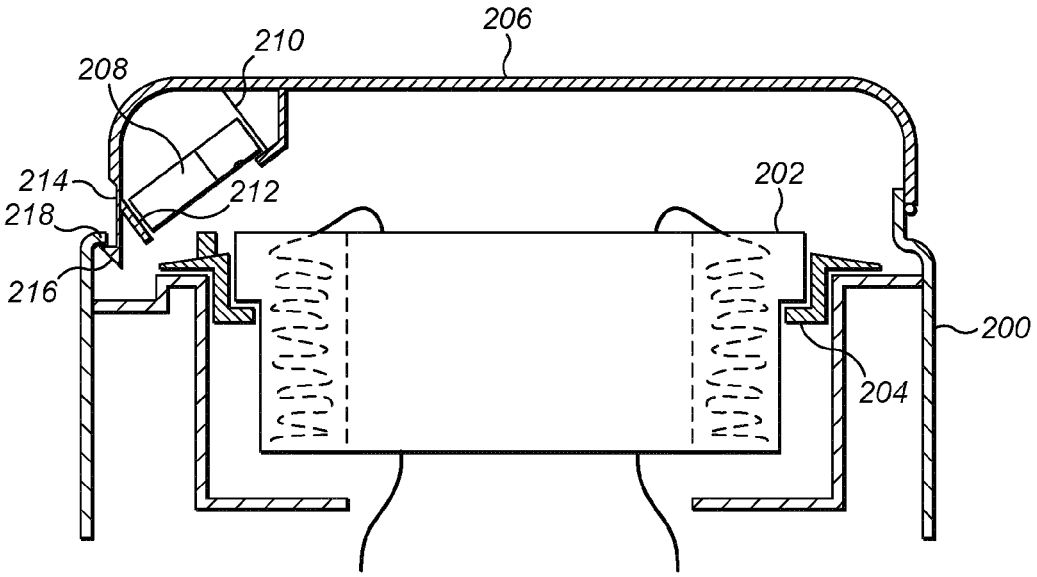
FIG. 3 shows a cross section through an upper portion of an improved waste storage device including a dispenser with a waste storage cassette housed therein.

FIG. 3 shows an improved waste storage system. The improved waste storage system comprises a waste storage device 200, shown in FIG. 3 with a waste storage cassette 202 housed therein. As the skilled reader will appreciate, the device 200 and cassette 202 can be manufactured and sold independently of one another. In FIG. 3 the cassette 202 is suspended from a shelf 204 provided in an upper portion of the waste storage device 200. Such a shelf 204 may be fixed within the waste storage device or it may be movable therein, for example it may be comprised in a waste cassette rotator which can rotate about a central axis inside the device 200. Rather than being suspended, the cassette could be supported on a formation inside the waste storage device 200.

The waste storage device 200 as shown in FIG. 3 further comprises a lid 206. The lid 206 can be opened and closed to provide user access to the inside of the waste storage device 200. In FIG. 3 the lid 206 is pivotally attached to an upper portion of the waste storage device 200, however any suitable attachment between the lid 206 and waste storage device 200 may be used. Housed inside the lid 206, in the upper left hand corner of the cross-section shown in FIG. 3, is a dispenser 208. The dispenser 208 comprises a storage portion and a spray mechanism. In the device shown in FIG. 3, the dispenser 208 is a canister which has an actuator at its top end which can be depressed to activate the spray mechanism. The storage portion can contain liquid or gas, for example compressed gas, which can act as an anti-bacterial agent and/or an anti-odour agent. If anti-odour agent is used it can comprise fragrance and/or deodorising chemicals. By way of example, the anti-bacterial agents could be based on silver ion technology.

The dispenser 208 is activated by opening the lid 206. As shown in FIG. 3, the dispenser 208 can be housed between first 210 and second 212 projections which project from an inner surface of the lid 206. The first projection 210 lies substantially flush with an upper surface of the dispenser 208 in situ and the second projection lies substantially flush with a lower surface of the dispenser 208 so that the dispenser is effectively wedged therebetween. Alternatively or additionally, the projections 210, 212 could comprise engagement means for fitting around or interlocking with the dispenser 208 in order to hold it in place.

In the device shown in FIG. 3, the location of the second projection 212 is selected so that a force exerted by the user on an outer surface of the lid 206 of the waste storage device 200 in order to open the lid 206 will cause displacement of the second projection 212. To achieve this, the lid 206 includes a thin portion 214 which terminates in a hook 216. The hook 216 interacts with a lip 218 on the waste storage device 200 in order to provide engagement between the lid 206 and the waste storage device 200 and thereby close the lid 206. Due to its reduced thickness as compared to the rest of the lid 206, the thin portion 214 is quite flexible. Therefore the user can press the thin portion 214 in order to flex it and disengage the hook 216 from the lip 218 of the waste storage device 200, thereby opening the lid 206. Such a movement of the thin portion 214 as shown in FIG. 3 will cause flexion of the second projection 212 inside the lid 206 but will not cause flexion of the first projection 210. As a result, a force is exerted on the ends of the dispenser, depressing the actuator at the top end and thereby activating the dispenser 208 to spray out some of the agent stored therein. As mentioned above, the agent can be anti-bacterial, and/or anti-odour, such that when the user opens the lid 206 to place a waste package inside the waste storage device 200, he or she will be presented with a clean and odour free surface inside the waste storage device 200.

The dispenser 208 as shown in FIG. 3 can be angled so as to distribute agent onto a selected surface inside the waste storage device 200. For example it could spray anti-bacterial or anti-odour agent on the flexible tubing being dispensed from the waste storage cassette 202, into which the user will place a waste object. Furthermore, the dispenser 208 can be arranged so that a limited portion of the agent will be sprayed out upon user actuation of the lid 206. Various types of spray mechanisms, canisters and aerosols will be well known to the skilled reader, many of which can provide controlled portions, such that they will not be described in detail herein.

Figure 4:
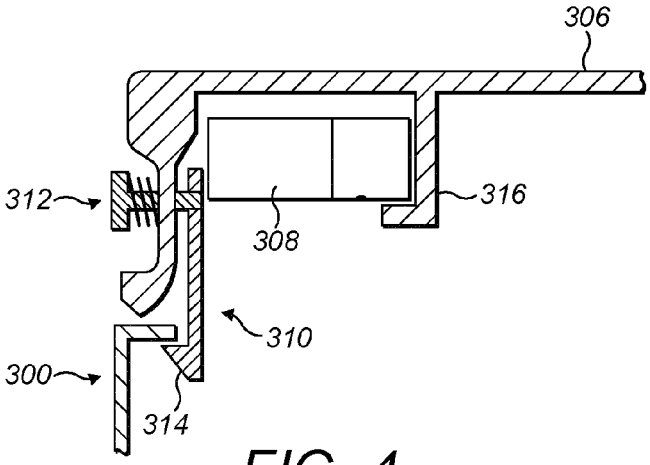
FIG. 4 shows a cross section of a portion of the upper section of an alternative to the improved waste storage device of FIG. 3.

FIG. 4 shows an alternative device including a dispenser 308 housed inside the lid 306 of a waste storage device 300. In this device, instead of an end of the lid 306 having a depressible thin portion, there is provided a substantially L-shaped actuator 310. A first branch of the L-shaped actuator 310 comprises a push button at one end, external to the lid 306, for a user to actuate in order to open the lid 306. The first branch extends through the lid 306 and in the device shown on FIG. 4 terminates substantially flush with a bottom surface of the dispenser 308 housed therein. The second branch of the actuator 310 extends downwards substantially perpendicular to the first branch and has a hook 314 on its distal end for inter-engaging with the waste storage device 300 in order to close the lid 306. There is a projection 316 extending substantially downwards from an inner surface of the top of the lid 306 so that the dispenser 308 is housed between the L-shaped actuator 310 and the projection 316. In operation, when a user presses the push button 312 this causes displacement of the L-shaped actuator 310 in order to unhook it and therefore release the lid 306 from the waste storage device 300. At the same time, displacement of the L-shaped actuator 310 causes displacement of the dispenser 308, which depresses the spray mechanism and therefore releases a spray of anti-bacterial and/or anti-odour agent from the dispenser 308.

As will be appreciated from FIG. 4, the components shown therein can be sized appropriately so that the dispenser 308 fits comfortably within the lid 306 without interfering with any other component parts of the waste storage device 300 or with a waste storage cassette or cartridge housed therein. Furthermore the size and configuration of the components can be selected so that a desired amount of spray can be distributed to selected areas inside the waste storage device 300 in order to present a clean and odour free environment to the user.

Whilst FIGS. 3 and 4 show two particular devices wherein user actuation to open the lid of a waste storage device activates a dispenser housed therein, other variations may be used without departing from this principle of operation. For example the lid may be opened by a different mechanism such as another type of deformable or spring loaded actuator.

The lid need not comprise a hook for engaging with the waste storage device but may engage with the waste storage device via any other suitable locking or inter-engagement means. Furthermore, although FIGS. 3 and 4 show a dispenser which has a depressible actuator or portion at its upper end, other types of dispenser may equally be used. For example the dispenser may include a hinge mechanism whereby a first portion of the dispenser is fixed relative to an inner surface of the lid or waste storage device and a second portion of the dispenser, hingedly attached to the first portion, is arranged to be deformed when the user presses an actuator to open the lid, whereby deformation of the second portion of the dispenser causes it to hingedly move towards the first portion and thereby release a spray of agent inside the waste storage device.

The waste storage device may comprise a foot pedal for opening the lid. A suitable lever or other mechanism for opening the lid of a waste storage device upon depression of a foot pedal will be known to the skilled reader and therefore will not be described in detail herein. However an example of a waste storage device having a foot pedal operated lid can be seen in FIG. 5. As shown therein, the lid 506 is connected to the foot pedal 504 via at least one substantially vertical connector 502 extending downwardly from the lid 506 and at least one substantially horizontal connector 508 hingedly attached to the substantially vertical connector 502 and having the foot pedal 504 arranged at its distal end. The waste storage device 500 of FIG. 5 is shown with a waste storage cassette 510 housed therein.

Figure 5:
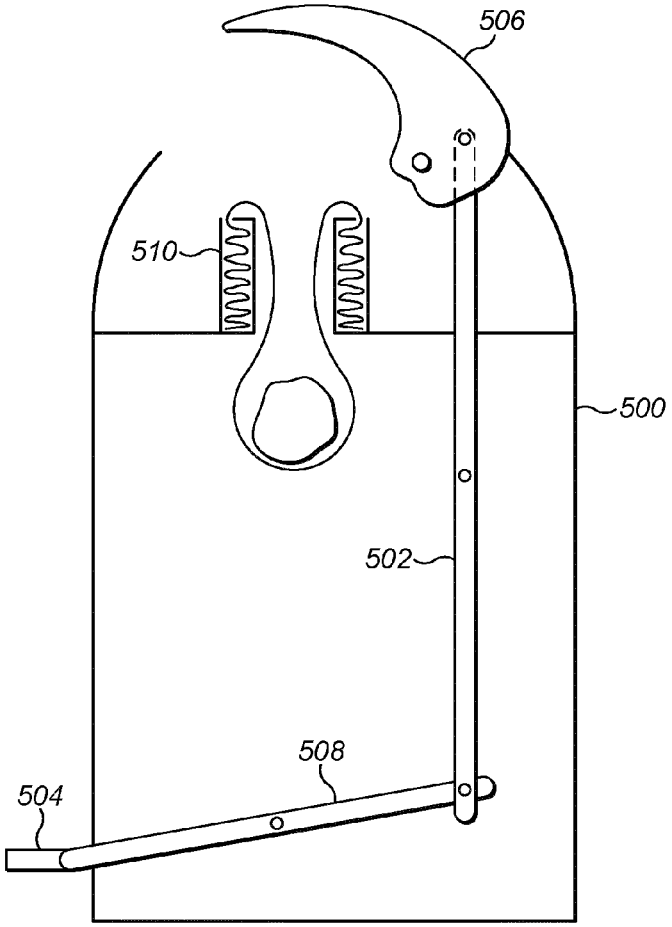
FIG. 5 shows a cross section of a known foot pedal operated waste storage device with a waste storage cassette housed therein.
Figure 6:
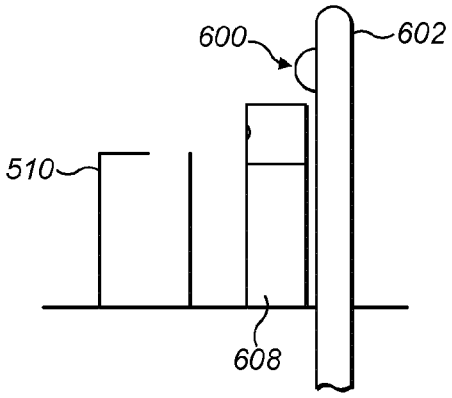
FIG. 6 shows a cross section of a portion of an improved foot pedal operated waste storage device.

A dispenser for dispensing anti-bacterial and/or anti-odour agent may be incorporated into a foot pedal operated waste storage device such as the one shown in FIG. 5 in a number of ways. One possibility is shown in FIG. 6. As can be seen therein, a dispenser 608 for dispensing anti-bacterial and/or anti-odour agent is provided in a foot pedal operated waste storage device such as the one shown in FIG. 5, located adjacent to and inward of the substantially vertical connector 602 therein. The dispenser 608 shown in FIG. 6 may be a canister or another type of dispenser which has a depressible actuator or portion at the top of the dispenser 608.

The substantially vertical connector 602 comprises a protrusion 600 which projects from a side of the connector 602 towards the dispenser 608. The substantially vertical connector 602 in FIG. 6 is shown in a raised position which occurs when the foot pedal has been operated and the lid is open. As can be seen from FIG. 6, the protrusion 600 is positioned vertically above the top of the dispenser 608 when the lid is in the open position. When the lid closes the substantially vertical connector 602 will move downwards and therefore the protrusion 600 will also move downwards to meet the dispenser 608 and to exert pressure thereon. Such pressure of the protrusion 600 on the dispenser 608 activates the dispenser 608 to release a spray of agent inside the waste storage device, for example onto flexible tubing dispensed from the waste storage cassette 510 housed therein. Closure of the lid may happen automatically upon release of the foot pedal or may be controlled by the user such that the user can exert sufficient downward force to ensure that the protrusion 600 presses down on the dispenser 608 in order to release a spray of agent.

Figure 7:
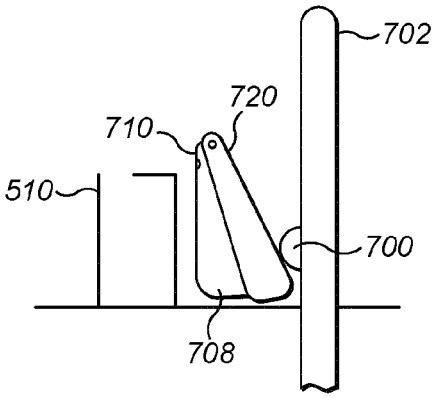
FIG. 7 shows a cross section of a portion of an alternative to the improved foot pedal operated waste storage device of FIG. 6.

FIG. 7 shows a variation on the arrangement shown in FIG. 6 wherein a hinged dispenser 708 is provided between the substantially vertical connector 702 and the waste storage cassette 510 in a foot pedal operated waste storage device. The dispenser 708 can be held in place by any suitable means so that a first portion 710 of the dispenser 708 remains stationary during actuation of the lid whilst a second portion 720 of the dispenser, hingedly attached to the first portion 710, can be moved during actuation of the lid. A protrusion 600 is provided on the substantially vertical connector 702, protruding towards the dispenser 708 such that during closure of the lid the protrusion 600 will exert pressure on the dispenser 708, causing movement of the second portion 720 towards the first portion 710 of the dispenser, thereby releasing a spray of agent therefrom.

In the arrangements shown in FIGS. 6 and 7 it is possible for the dispenser and protrusion to be arranged so that the protrusion only causes the dispenser to spray during downward movement of the substantially vertical connector as described above or they can be arranged so that the protrusion causes the dispenser to spray both on upward and downward movement of the substantially vertical connector. By spraying both when the lid opens and when the lid closes in this manner, the system enables bacteria and/or odours to be suppressed just after a waste package has been deposited in the waste storage device, so that the bacteria and/or odour does not linger or spread between consecutive uses of the device. Furthermore it ensures that a fresh spray will occur as the user opens the lid of the device, therefore ensuring that the device is clean and fresh for the next use. This can be useful when there are relatively long delays between successive uses of a waste storage device.

Figure 8:
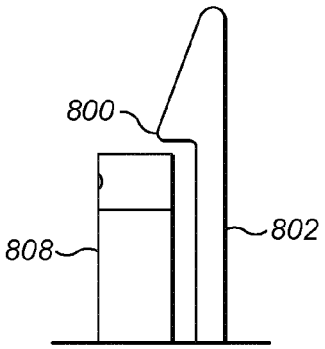
FIG. 8 shows a cross section of a portion of another alternative to the waste storage device of FIG. 6.

An alternative means for actuation of a dispenser 808 in a foot pedal operated waste storage device is shown in FIG. 8. As can be seen therein, a profiled projection 800 is provided on the substantially vertical connector 802. The profiled projection 800 protrudes from the connector 802, towards the dispenser 808, at its lower end and is profiled so as to slope inwardly and upwardly from that lower end back towards the connector 802. As a result of this profiling, the operation of the protrusion 808 is controlled since the risk of it actuating the dispenser 808 whilst the substantially vertical connector 802 is moving upwards during opening of the lid is reduced. The profiled projection 800 will instead only depress the dispenser 808 during downward movement of the connector 802 as the lid is being closed.

Another known approach for opening and closing a lid of a waste storage device is to use a gear mechanism. An example of such a device is shown in FIGS. 9B and 9C. The device 920 includes a gear arm 922 which connects to the lid 926 of the device 920 at one end and acts as a rack gear. The gear arm 922 can move through a hole or recess in the body of the device 920 during opening and closing of the lid 906.

Although not shown in the figures, the device may include a series of gear wheels inside the gear waste storage device which interact with the arm 922. Rotation of the gears inside the device can therefore cause the gear arm 922 to move up and down, opening and closing the lid. Optionally, the device may also include gear teeth around a cassette or cartridge placed inside the device, for rotating that cassette or cartridge.

In the device shown in FIGS. 9B and 9C, a dispenser 924 is provided which cooperates with the gear mechanism. The dispenser can be of the type shown in any of FIG. 3, 4, 6, 7 or 8 herein or any other appropriate type. The dispenser 924 is fixed at a stationary point within the waste storage device 920 and can interact with a protrusion 928 provided on the gear arm 922 that attaches to the lid 926. Therefore, during opening and/or closing of the lid 926, the protrusion 928 will contact the dispenser 924, causing it to spray.

As an alternative to the arrangement shown in FIGS. 9B and 9C, the dispenser can be fixed to the gear arm itself. A protrusion can be provided at a stationary point inside the waste storage device, which the dispenser will travel past during actuation of the arm during opening and/or closing of the lid. By passing this protrusion, the dispenser will be deflected or deformed in order to spray an agent therefrom.

It will be appreciated that the dispenser and cooperating protrusion can be used with a variety of mechanical arms which move during opening and closing of the lid of a waste storage device. They do not require the arm to include a rack gear.

Figure 9A:
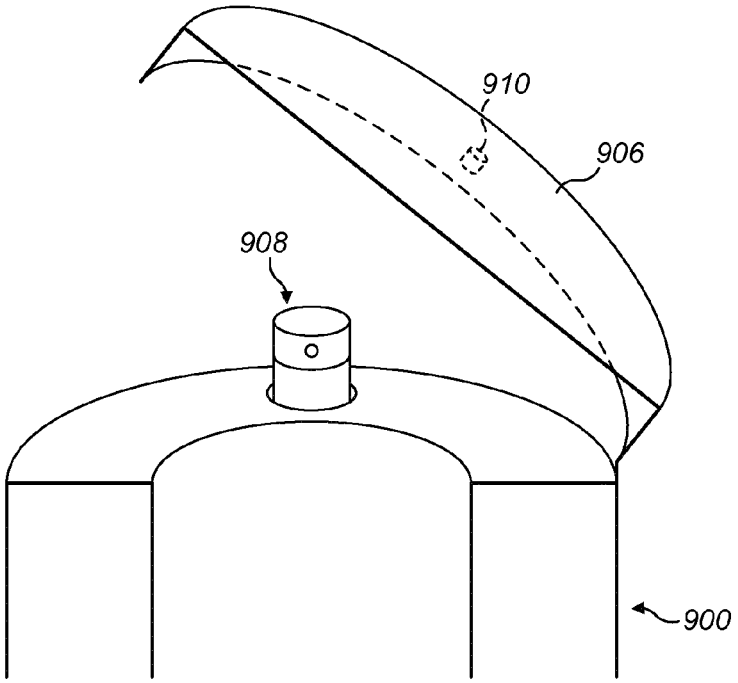
FIG. 9A shows a cross section of an improved waste storage device.
Figure 9B:
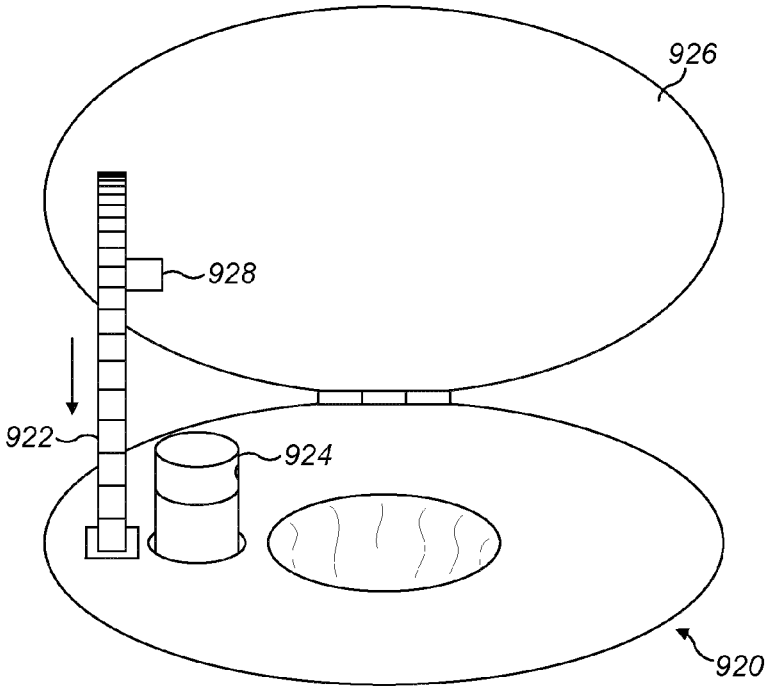
FIG. 9B shows a front view of an improved waste storage device including a gear arm.
Figure 9C:
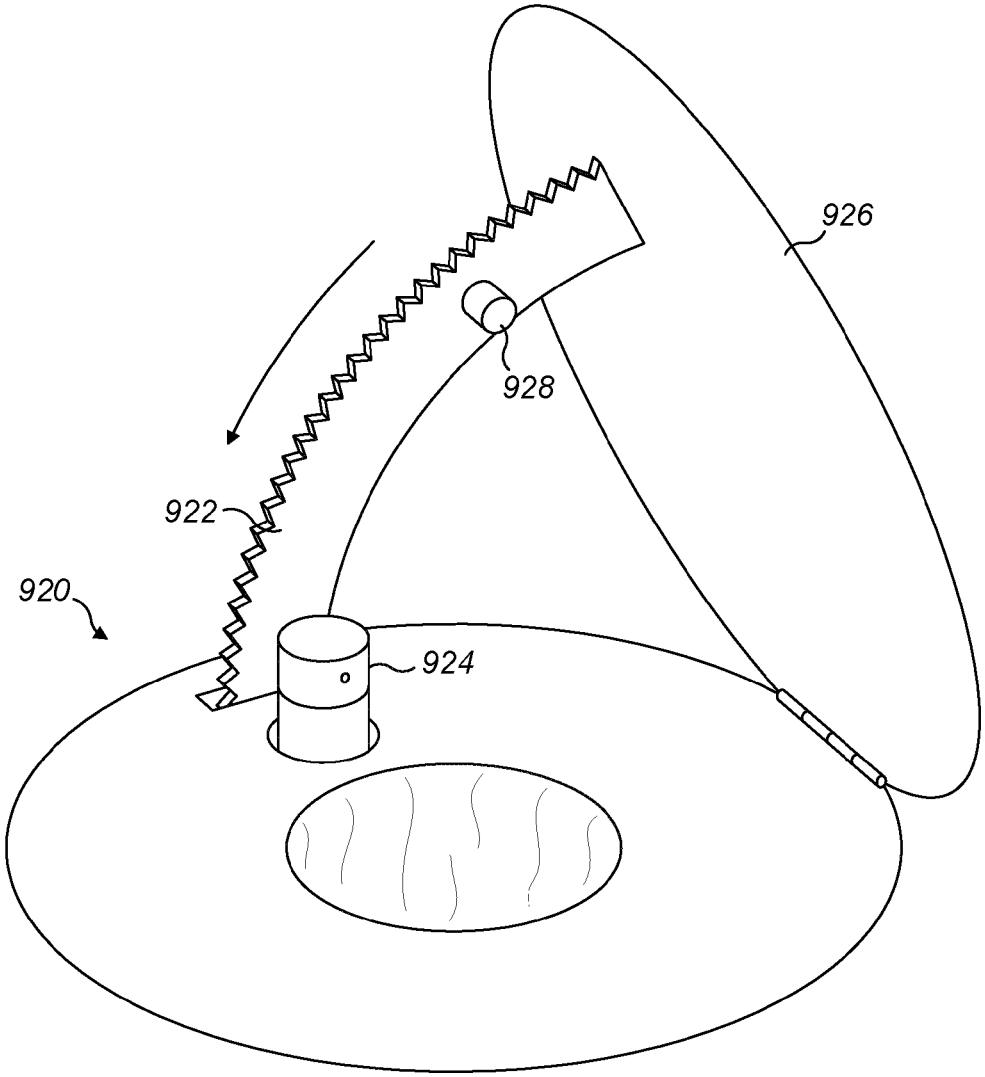
FIG. 9*c* shows a side view of the device shown in FIG. 9*b;*

FIG. 9A shows a waste storage device 900 wherein an inner surface of the lid 906 is used directly to activate a dispenser 908 in the waste storage device 900. The lid 906 may be opened by actuation of a foot pedal, a gear aim, another type of mechanical arm or simply by a user lifting the lid 906. The dispenser 908 is housed in an upper portion of the waste storage device 900 such that, when the lid 906 closes, an inner surface thereof presses down on the dispenser 908 and therefore causes it to spray. In such a an arrangement, it is important for the dispenser 908 to spray a limited portion of agent rather than to continue spraying at all times while the lid is closed. Dispenser types which can spray in controlled portions are well known.

In FIG. 9*a* a pin 910 is provided on an inner surface of the top of the lid 906. The pin projects downwardly from the inner surface of the lid, towards the body of the waste storage device 900. Therefore when the lid closes the pin 910 can depress an actuator or other portion on the dispenser 908, causing it to spray.

According to a variant, the pin 910 does not press on the dispenser 908 merely by closing the lid 906. Instead, a push button or other actuator is provided on an outer surface of the lid 906 whereby the user must press on that button or actuator to depress the pin 910 and thereby press down on the dispenser 908, causing it to spray. This sort of arrangement enables the dispenser 908 to comprise a pressured container since the dispenser would not be permanently depressed by the pin when the lid is closed.

Whilst a pin 910 has been shown in FIG. 9*a* as being provided for activating the dispenser 908, it is possible to use another type of formation for the same purpose. For example, in order for the dispenser 908 to interfere as little as possible with the normal operation of the waste storage device 900, a recess may be provided in the top of the lid, wherein the top of the dispenser 908 fits into that recess and wherein such engagement activates the dispenser 908 to spray.

In the above-described devices the dispenser can be arranged substantially vertically or horizontally, or at any other suitable angle inside a waste storage device during use. It can be housed within the lid or in another portion of the waste storage device as appropriate, without interfering with other components of the waste storage device. For example it can be located in a recess in a portion of the device and/or it can be clipped, slid or locked into place in the waste storage device. The means for fitting the dispenser to a waste storage device can be manufactured integral with such a device or such means can be retrofitted to an existing waste storage device in order to improve its operation.

Reservoir for Liquid Release

Figure 10:
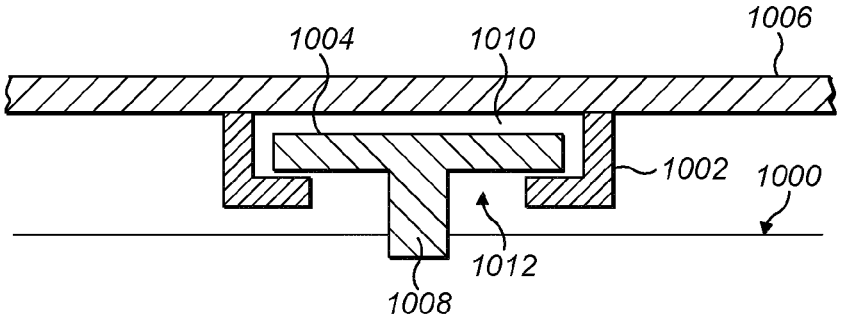
FIG. 10 shows a cross section of an upper part of an improved waste storage device including a reservoir type dispenser.

Instead of providing a spray type dispenser, it is possible to use other dispenser types in order to distribute anti-bacterial and/or anti-odour agent in a waste storage device. One such dispenser is shown in FIG. 10. As shown therein, a reservoir 1010 of anti-bacterial and/or anti-odour agent may be provided under the surface of the lid 1006 of a waste storage device 1000. For example an essential oil or a fragranced liquid or liquid containing deodorising chemicals may be provided in the reservoir 1010. In FIG. 10 the reservoir is formed by a cap 1002 affixed to an under surface of the lid 1006. The cap 1002 may screw into the lid or may affix thereto by any other suitable means. The cap 1002 as shown in FIG. 10 includes an opening 1012 on its lowermost surface via which liquid comprised within the reservoir 1010 can be distributed. In order to control that distribution, the opening 1012 is at least partially stopped. The stopper 1004 shown in FIG. 10 comprises an absorbent material such as felt. In use, liquid in the reservoir 1010 will impregnate the stopper 1004 and will slowly and steadily seep out of the stopper 1004, into the waste storage device 1000 therebelow.

To control dispensing of the liquid from the reservoir 1010, and possibly to enhance interengagement of the lid 1006 and main body of the waste storage device 1000 shown in FIG. 10, a pin 1008 is provided projecting upwards from the waste storage device 1000. The pin 1008 can mate with the opening 1012 at the bottom of the reservoir 1010. In this arrangement, the liquid can be prevented or generally restricted from leaving the reservoir 1010 when the lid 1006 is closed—there being much less need for dispensing the liquid when the lid is closed for relatively long periods of time between uses. The pin 1008 can be made from a non-absorbent material such as plastic to effectively prevent the liquid from leaving the reservoir or, alternatively, can form a wick of absorbent material so that the liquid from the reservoir 1010 is released from two different locations once the lid is opened.

The reservoir 1010 as shown in FIG. 10 can be emptied, cleaned, refilled or replaced as desired during use of the waste storage device 1000. For example, the cap 1002 may unscrew from the under surface of the lid 1006 in order for this to happen.

Figure 11:
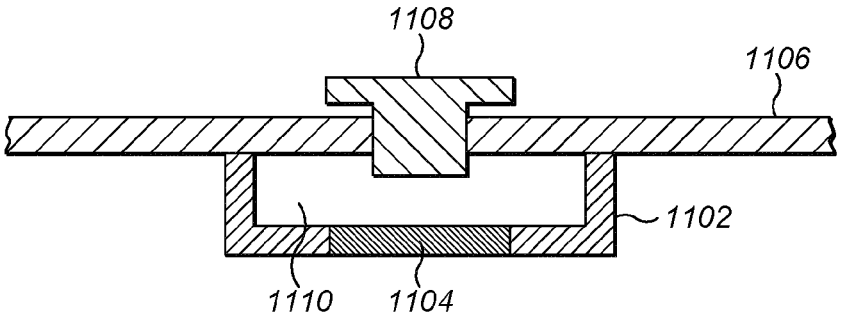
FIG. 11 shows a cross section of a waste storage device including a reservoir type dispenser.

Another arrangement including a reservoir is shown in FIG. 11. As shown therein, a reservoir 1110 of anti-bacterial and/or anti-odour agent, such as a fragrance, is provided underneath the lid 1106 of a waste storage device. The reservoir 1110 is formed by a cap 1102 which protrudes downwardly from an under surface of the lid 1106 and is permanently affixed thereto. At least part of the lowermost surface of the cap 1102 comprises an absorbent material 1104 such as felt. Fragrance or other agent from the reservoir can therefore seep through the absorbent material into the waste storage device below. Because the cap 1102 is permanently fixed to an under surface of the lid 1106, a plug 1108 is provided on an outer surface of the lid 1106, extending downwardly into the reservoir 1110. The plug 1108 forms an airtight seal in order to prevent fragrance escaping out of the waste storage device, and is removable so that the reservoir 1110 can be refilled and/or cleaned as desired during use. The absorbent material 1104 can be arranged to locate with a pin sited on the main body of the waste storage device, to control the release of the agent, as per FIG. 10.

Figure 12:
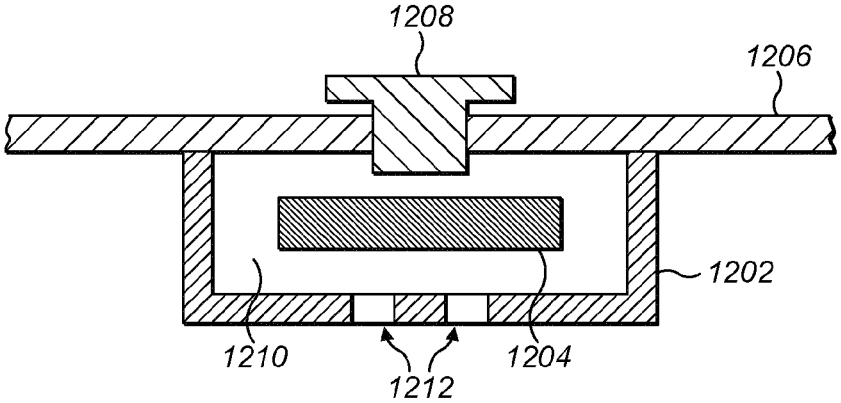
FIG. 12 shows another reservoir type dispenser.

Another arrangement is shown in FIG. 12. As shown therein, a reservoir 1210 of anti-bacterial and/or anti-odour agent is provided underneath the lid 1206 of a waste storage device. The reservoir 1210 is formed in a cap 1202 that can fix to the lid by any suitable means such as by a push fit or screw fit attachment. A plug 1208 is provided to provide an airtight seal between the reservoir of fragrance or other agent and the outside of the waste storage device. The reservoir 1210 includes a wick 1204 of absorbent material. The wick 1204 shown in FIG. 12 occupies only a portion of the reservoir 1210 volume however it may be larger, occupying substantially the entire volume of the reservoir 1210, so that fragrance or other agent soaks into the wick 1204 when the reservoir 1210 is filled.

The lowermost surface of the cap 1202 in FIG. 12 comprises one or more vents 1212. These vents 1212 enable agent from the reservoir 1210 to evaporate and to be distributed out into the body of the waste storage device. The vents comprise a channel, optionally including a mesh in order to control the distribution of the agent from the reservoir to the device. For example, the vents 1212 may include a mesh or grid which prevents the agent in the reservoir 1210 from travelling through the vents 1212 except when a force is applied thereto, for example the force encountered when the lid 1206 is opening or closing. Therefore the vents 1212 can act to sprinkle agent from the reservoir 1210 onto the waste storage device below during actuation of the lid. The stopper 1004 and/or the absorbent material 1104 shown in FIGS. 10 and 11 respectively can work in a similar manner, wherein liquid from the reservoir can only travel therethrough into the waste storage device during movement of the lid. Alternatively, the agent from the reservoir in any of the arrangements shown in FIGS. 10 to 12 may travel out towards the waste storage device on a continual basis.

Dispenser for Dispensing Powdered Anti-Bacterial and/or Anti-Odour Agent

Figure 13:
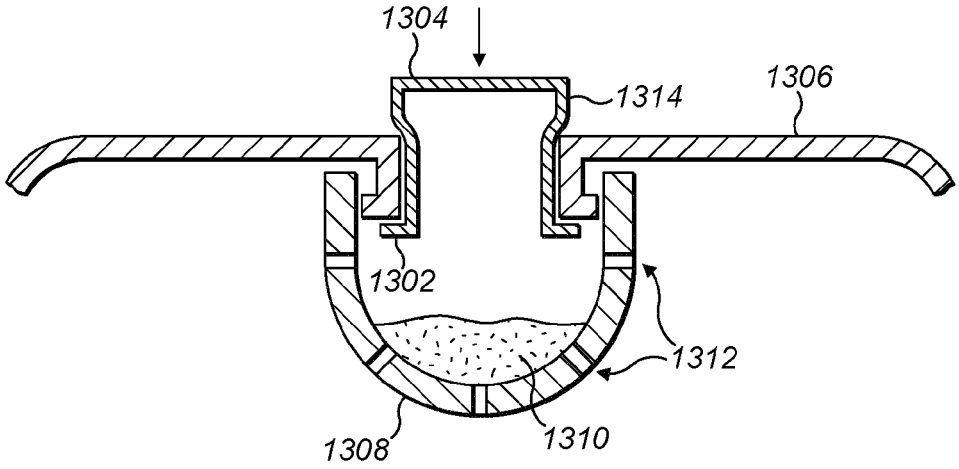
FIG. 13 shows a cross section of an upper part of an improved waste storage device including a powder dispenser.

The anti-odour and/or anti-bacterial agent in a waste storage device can be supplied in powder form. A powder dispenser is shown in FIG. 13. The dispenser 1308 is provided on an undersurface of the lid 1306 of a waste storage device. The dispenser may be formed of plastic or any other suitable material. In FIG. 13 the dispenser is dome-shaped or substantially U-shaped in cross-section but any other shape that forms a cavity in which powder can be held could be used.

The dispenser 1308 fixes to the lid 1306 in FIG. 13 via a screw thread however a push fit or other type of engagement may be used. The dispenser 1308 comprises a number of holes 1312 extending from its inner surface to its outer surface. The holes 1312 may be completely hollow, providing a direct channel between the inner and outer surfaces of the dispenser 1308. Alternatively, a grid or mesh may be provided in the holes 1312 in order to partially block or filter passage of material therethrough.

The dispenser 1308 is filled with a powder agent 1310 which can have anti-bacterial and/or anti-odour properties. It may also have other properties, for example it may absorb moisture. Examples of such powdered agents include activated carbon, bicarbonate of soda, silica gel or other known chemicals with suitable properties.

A push button 1304 is provided over a gap in the outer surface of the lid 1306 of the waste storage device, extending down into the cavity formed by the dispenser 1308 under the lid 1306. The push button 1304 provides an airtight seal so that no powder can escape from the dispenser 1308 to outside of the lid 1306. This is achieved in the arrangement shown in FIG. 13 by providing a lip 1302 at the bottom end of the push button which hooks under a formation on the lid 1306, blocking passage of powder out of the lid 1306. In addition, the extent to which the push button 1304 can move with respect to the lid 1306 is restricted because it includes a wide portion or shoulder 1314 at its upper end which cannot fit through the hole in the lid 1306. Hence, pushing the top surface of the push button 1304 acts only to move the air underneath it, not to permanently dislodge the push button 1304 itself.

The dispenser 1308 may distribute powder 1310 therefrom when the lid 1306 is being opened or closed, during which times the dispenser will be moved. Alternatively or additionally, the push button 1304 may be used to agitate the powder 1310 and therefore distribute it from the dispenser 1308 into the body of the waste storage device therebelow. Because the push button 1304 extends out of the lid 1306, a user can depress the push button 1304 in order to distribute the powder inside the waste storage device when the lid is closed, thereby ensuring that the powder does not distribute outside of the waste storage device, which would otherwise cause a mess and waste powder 1310. The actuation of the push button 1304 in FIG. 13 will displace a small amount of air into the powder to agitate it and thereby cause a measured dose of the powder 1310 to travel out of the holes 1312 in the dispenser 1308, into the waste storage device. Therefore a tidy and controlled system for dispensing the anti-odour and/or anti-bacterial agent in powder form is provided.

Instead of providing a push button as shown in FIG. 13, an alternative user actuation means can be provided on the outside of the lid 1306. For example, there may be a gap provided in the surface of the lid above the dispenser 1308 and a flexible membrane may be provided covering that gap, wherein the flexible membrane stretches when the user presses thereon. Such stretching of the flexible membrane down into the cavity formed by the dispenser 1308 will agitate the air therein, forcing powder 1310 out of the holes 1312.

Figure 14:
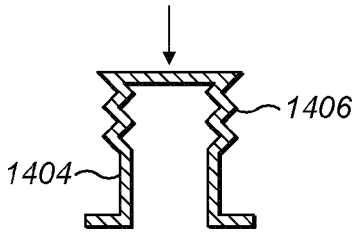
FIG. 14 shows an alternative actuator for the device of FIG. 13.

The moveable push button 1304 as shown in FIG. 13 may be replaced by an actuator 1404 including a bellows portion 1406 as shown in FIG. 14. In such an arrangement, the base of the actuator 1404 is fixed in or to the lid and is not moveable with respect thereto but the bellows portion 1406 is flexible, such that user pressure on top of the actuator 1404 will compress the bellows portion 1406, agitating air in the dispenser therebelow and therefore pushing powder out of the holes or vents in the dispenser.

Figure 15:
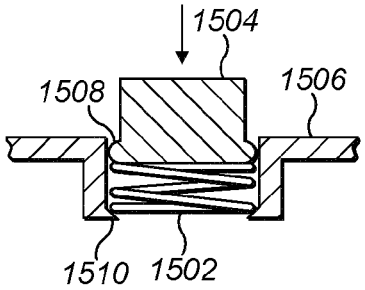
FIG. 15 shows another alternative actuator for the device of FIG. 13.

An alternative to the push button 1304 of FIG. 13 is shown in FIG. 15. The actuator therein comprises a rigid piston or plunger 1504 situated in a gap in the surface of the lid 1506 of a waste storage device. A flexible seal 1508 is provided between the rigid piston or plunger 1504 and the lid 1506, so that no air can escape therethrough. A spring 1502 is provided underneath the rigid piston or plunger 1504, so that user depression of the rigid piston or plunger 1504 will cause it to move downwards, agitating the air in the dispenser therebelow, and to spring back upwards again thereafter. A stop 1510 is provided in order to limit motion of the rigid piston or plunger 1504 and to fix the spring 1502 in place.

Figure 16:
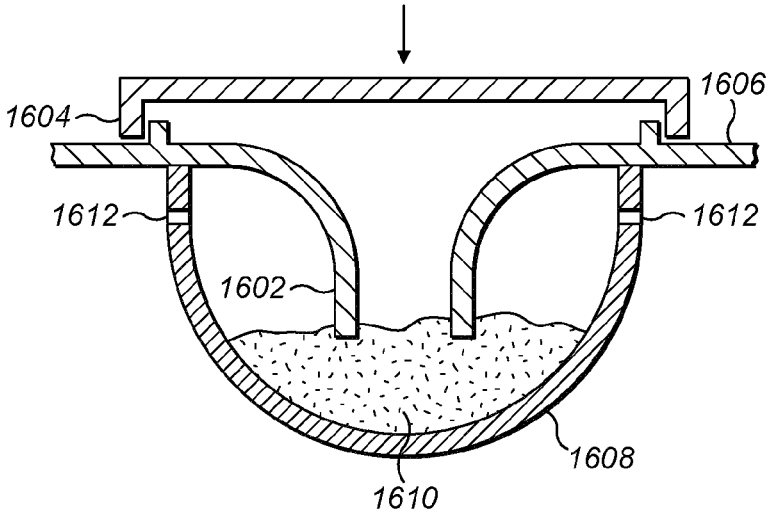
FIG. 16 shows a cross section of an alternative powder dispenser.

In the arrangements described above with respect to FIGS. 13 to 15 the user can depress or deflect an actuator on the outside of the lid of a waste storage device in order to cause movement of air in a dispenser cavity, thereby agitating the powdered agent therein in order to distribute that agent in a controlled manner within the waste storage device. FIG. 16 shows an alternative arrangement which works on the same principles as the arrangements of FIGS. 13 to 15, but wherein actuation of the actuator outside the lid creates a direct airflow into the powder in the dispenser. This direct airflow into the powder magnifies the impact of the user's force on the powder and therefore enables a smaller user movement to be made in order to distribute powder from the dispenser.

In FIG. 16 an actuator 1604 is provided on an outer surface of the lid 1606 of a waste storage device. The actuator 1604 in FIG. 16 could comprise, inter alia a push button, stretchable membrane, bellows or piston already described in relation to FIGS. 13, 14 and 15.

The actuator 1604 extends over a gap in the surface of the lid 1606. Therefore an airtight seal is formed between the actuator 1604 and the lid 1606, in order to prevent powder from escaping out of the waste storage device. In FIG. 16 the airtight seal is formed by a downwardly extending lip on the actuator 1604 engaging with an upwardly extending protrusion on lid 1606. However any other suitable type of airtight seal may be provided. In FIG. 16 the cross-section of the lid slopes downwardly to form a funnel 1602 around the gap in its surface, underneath the actuator 1604. The funnel 1602 extends downwardly into the cavity formed by a dispenser 1608 which is attached to an undersurface of the lid 1606. The cavity in FIG. 16 is shown as being domed, i.e. U-shaped in cross-section, but other shapes of dispenser are possible. The funnel 1602 extends towards but not right to the bottom of the dispenser 1608. Therefore when the dispenser is at least partially full of powder 1610 as shown in FIG. 16, the funnel 1602 protrudes down into the powder 1610. As a result, when a user pushes down on the actuator 1604 outside the lid 1606, this downward compression will force air directly into the powder 1610, as directed by the funnel 1602. This will cause agitation of the powder 1610, thereby forcing at least some of it out of the dispenser 1608.

The dispenser 1608 in FIG. 16 comprises vents or holes 1612 which enable the powder 1610 to escape therefrom. The holes shown in FIG. 16 are arranged high up on the dispenser 1608, close to the undersurface of the lid 1606. As a result, powder will not fall out of the holes 1612 during normal operation of the device, potentially including when the lid 1606 is moved up and down. Instead, the powder 1610 will only be sufficiently agitated in order to escape from the holes 1612 when the user presses down on the actuator 1604.

Figure 17:
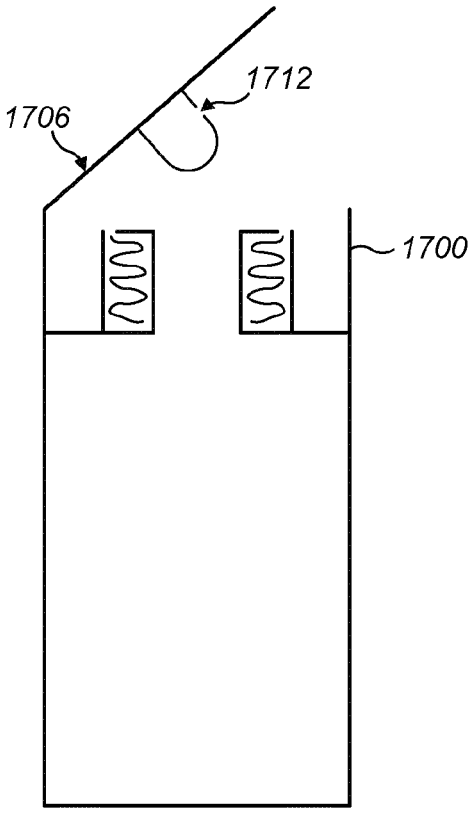
FIG. 17 shows a cross section of a waste storage device with another alternative powder dispenser.

Although in FIG. 13 the holes 1312 are shown evenly distributed around a surface of the dispenser 1308 therein, the positioning of the holes in such an arrangement can be selected to be similar to the positioning shown in FIG. 16. Any number of holes or vents may be provided. Additionally or alternatively, holes or vents may only be provided in a selected area on the surface of the dispenser. For example, FIG. 17 shows a device wherein there is an asymmetric distribution of holes 1712 on the dispenser so that normal opening and closing of the lid will angle the powder in the dispenser away from the holes and so will not shake powder out of the dispenser. Instead, powder can only vent through the holes if the air in the dispenser is deliberately agitated as described hereabove. The selection or arrangement of the holes or vents may depend on factors such as the density of the powdered agent, the size of the cavity created by the dispenser, the extent to which user actuation can agitate air in the dispenser and the desired dosing of the powder in the waste storage device can all be taken into account when choosing hole positioning in the dispenser. Similarly, the amount of agitation will depend on how much displacement you apply to the actuator.

In the arrangements shown in FIGS. 13 to 17 a one way valve may be provided in a suitable location in the surface of the lid or actuator so that air can get back into the cavity formed by the dispenser after the actuation, and hence agitation of the air, has finished. Also, although devices which require manual actuation have been described here above, the same effects can be achieved using automatic actuation. For example, a mechanism may be provided so that an actuator will automatically be depressed in order to agitate powder from a dispenser once the lid of a waste storage device has been closed after use.

Figure 18:
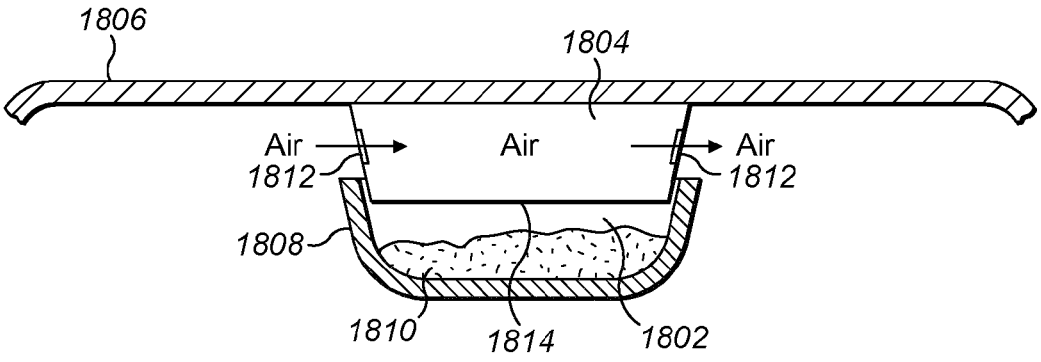
FIG. 18 shows a cross section of a two-part powder dispenser for a waste storage device.

Instead of agitating a powdered anti odour and/or antibacterial agent by directly agitating it with air, it is possible to agitate such powder indirectly. An arrangement of this type is shown in FIG. 18. The dispenser 1808 comprises a top portion 1804 and a bottom portion 1802 separated by a filter 1814. The holes or vents 1812 in the dispenser 1808 are provided only in the top portion 1804. At least two vents 1812 are provided, preferably arranged substantially diametrically opposite one another on the surface of the dispenser 1808 so that an air flow is defined therebetween. The top portion 1804 comprises only air, no powder 1810. On the other hand, the bottom portion 1802 is filled or at least partially filled with powder 1810 comprising an antibacterial and/or an anti odour agent. In operation, airflow through the top portion 1804 of the dispenser 1808 entrains some powder 1810 from the bottom portion 1802, thereby venting the powder 1810 out of the dispenser 1808 into the waste storage device.

In the arrangement shown in FIG. 18 there is no particular actuator for creating an airflow through the top portion 1804 of the dispenser 1808. When the lid 1806 of the waste storage device is opened or closed, this movement will naturally create an airflow through the vents 1812. The provision of the filter 1814 between the top 1804 and bottom 1802 portions of the dispenser 1808 ensures that the powder 1810 from the bottom portion 1802 does not merely fall out during movement of the lid. Instead, the filter provides a sufficient barrier only to allow a little powder 1810 through each time the lid is moved, wherein that powder is picked up by the moving air and vented out of the dispenser 1808 into the body of the waste storage device.

Figure 19:
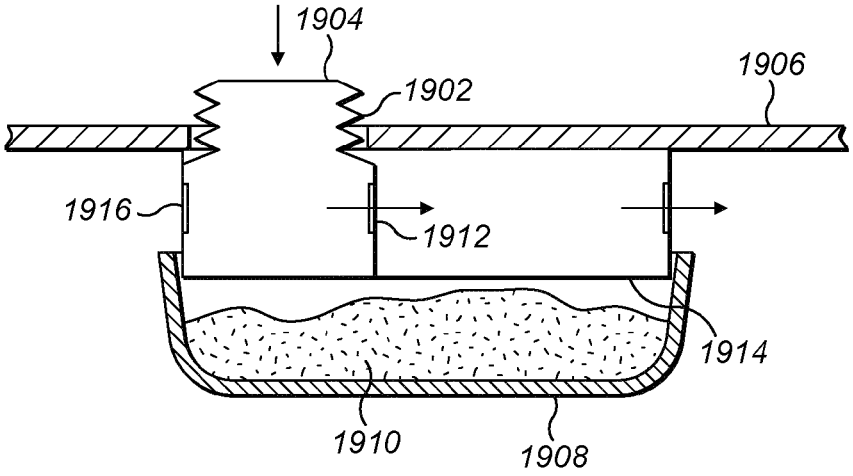
FIG. 19 shows an alternative two-part powder dispenser for a waste storage device.

An actuator may be provided to create turbulence to drive air across the top portion of a dispenser in order entrain powder for venting to a waste storage device. Such turbulence creation means may be within the cavity formed in an upper part of the dispenser or may be provided external to the dispenser, with an airflow defined between the turbulence creation means and the dispenser. FIG. 19 shows one such arrangement. As can be seen therein, an actuator 1904 including a bellows portion 1902 is provided extending from outside the lid 1906 of a waste storage device, into a dispenser 1908 provided underneath the lid 1906. As described above in relation to FIG. 14, user depression of the actuator 1904 can cause compression of the bellows portion 1902, thereby pushing air into the cavity below the actuator 1904. This will cause an airflow in an upper part of the dispenser 1908. A filter 1914 is provided between the upper part of the dispenser 1908 in which a plurality of holes or air vents 1912 are formed and a lower part in which powder 1910 comprising an antibacterial and/or an anti odour agent is deposited.

A one way valve 1916 is provided on a surface of the upper part of the dispenser 1908 in FIG. 19. This one way valve enables air to go back into the dispenser 1908 after actuating of the actuator 1904 has forced air out of the dispenser 1908, sending air and entrained powder into the main body of the waste storage device. The effect could be improved by having a flap on the outlet to allow entrained powder to escape from the dispenser 1908 without letting air back in. The overall effect would be to make sure that air flow through the dispenser is substantially in only one direction.

Instead of having an actuator including a bellows portion as shown in FIG. 19, an alternative actuator such as the movable actuator 1304 shown in FIG. 13 or the piston based actuator 1504 shown in FIG. 15 may be provided in order to create air movement above a layer of powder in a dispenser in order to entrain the powder and vent it out into a waste storage device. Such an actuator may be manually or automatically activated.

It is possible to include a fan in the arrangements described above in order to create air movement and entrain powder for venting into a waste storage device. The fan may be manually driven, for example the downward movement on a actuator including a bellows portion or piston as described above may be translated into rotational fan movement by any known method. Rotational movement of the fan will create additional turbulence above the powder in a dispenser and will strengthen the flow of air out of the holes or vents in the dispenser. Alternatively the fan may be driven by the movement of the lid on opening and/or closing the lid. Further alternatively, an energy storage means may be provided so that energy generated by movement of the lid is stored until the lid has been closed and the energy is then released to drive the fan to create an airflow to entrain powder from a dispenser in a waste storage device. By creating such an airflow when the lid of the waste storage device is closed, the movement of air and hence the distribution of the powder can be limited to within the waste storage device. Therefore powder use is more efficient and a neater powder distribution system is provided.

As an alternative, a fan may be provided which creates an airflow in an upper portion of a dispenser, above the powder therein, upon user actuation of another type of actuator outside the waste storage device. For example a pull cord may be provided on top of the lid in order to activate the fan. Such an arrangement is advantageous since the pulling of the cord generates rotation of the fan for a limited period of time, hence limiting the airflow and thereby controlling the distribution of the powder from the dispenser within the waste storage device. Instead of a cord, a wheel or spinner may be provided on an outer surface of the lid, wherein rotation of the wheel or spinner imparts rotational movement on the fan. Alternatively, a rotator handle may be provided on an outer surface of the lid wherein rotation of the handle rotates the fan.

Instead of agitating air inside a dispenser in order to distribute powder stored in the dispenser in a waste storage device, it is possible to agitate the entire dispenser in order to distribute the powder. As described with respect some of the arrangements above, if a dispenser is fitted to an underside of the lid of a waste storage device then movement of the lid itself can be sufficient to dispense powder from the dispenser. Furthermore, if the lid is left open and the user accidentally knocks into the waste storage device, in some cases this can cause dispensing of powder not only onto the desired areas of the waste storage device but also elsewhere, creating mess. Therefore it is desirable for agitation of the dispenser only to cause distribution of the powder therein under certain controlled circumstances.

Figure 20A:
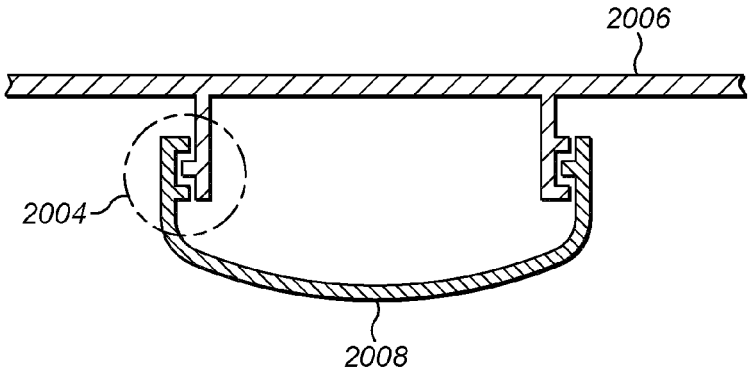
FIG. 20A shows a powder dispenser attached to the lid of a waste storage device via a screw mechanism.
Figure 20B:
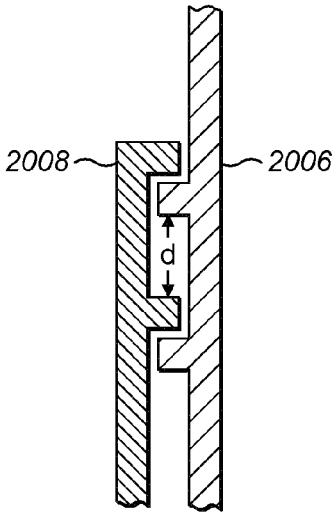
FIG. 20B shows the screw mechanism of the FIG. 20A in more detail.

One possible arrangement is shown in FIGS. 20A and 20B. As shown therein, a dispenser 2008 is provided on the underside of a lid 2006 of a waste storage device. Although not shown therein, a powder comprising antibacterial and/or anti odour agent can be stored in the dispenser 2008. Again not shown, vents or holes may be provided in the surface of the dispenser 2008 as described above with respect to the other arrangements, in order for powder to be shaken out of the dispenser 2008. The dispenser 2008 in FIG. 20A attaches to an underside of the lid 2006 via a screw mechanism 2004. The screw mechanism 2004 includes a large spaced thread as shown in more detail in FIG. 20B. As can be seen therein, whilst the lid 2006 and dispenser 2008 are reliably attached to one another via the screw mechanism 2004, it is possible for the dispenser to move up and down a distance 'd' with respect to the lid 2006 to which it is affixed. Therefore when the dispenser is directly knocked or shaken it can wobble or vibrate with respect to the lid 2006. Such wobbling or vibration can cause powder to be shaken out of the dispenser 2008 into the waste storage device therebelow.

Figure 20C:
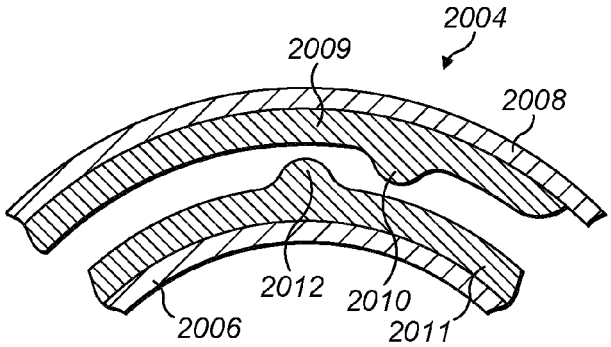
FIG. 20C shows an optional improvement of the screw mechanism of FIGS. 20A and 20B.

FIG. 20C depicts an optional improvement of the arrangement shown in FIGS. 20A and 20B. As can be seen therein, the screw mechanism 2004 includes a female thread 2009 on the dispenser 2008 and a male thread 2011 on the lid 2006. It further includes an inward protrusion 2010 protruding inwardly from the female thread 2009 and an outward protrusion 2012 protruding outwardly from the male thread 2011. These protrusions 2010, 2012 form a lock for the screw mechanism 2004. They therefore secure the dispenser 2008 to the lid 2006 while still allowing for relative vertical movement therebetween. In use, when fitting the dispenser 2008 to the underside of the lid 2006 the user turns the screw thread past the interference of the two protrusions 2010, 2012 but no further. The user is therefore given tactile feedback regarding the locking point of the screw mechanism 2004, and at the same time is given a warning that the screw mechanism 2004 should not be tightened any further, so as to maintain the potential for vertical displacement in the screw mechanism 2004.

Whilst the protrusions in FIG. 20C project radially, it is also possible to provide protrusions which extend in the axial direction in order to provide a similar interference and tactile feedback for locking of the dispenser to the lid of a waste storage device. Alternatively, an interrupted thread may be provided between the lid 2006 and the dispenser 2008 in order to secure the two together but with some room for relative movement.

Figure 21:
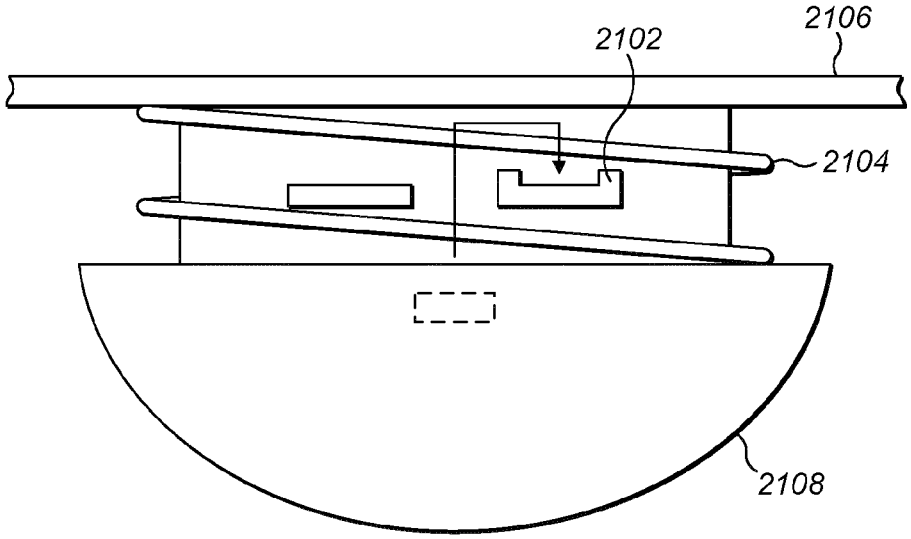
FIG. 21 shows a powder dispenser including a bayonet attachment.

As an alternative, a dispenser 2108 may affix to the lid 2106 of a waste storage device using a bayonet and spring mechanism, as shown in FIG. 21. This type of mechanism will be familiar to the skilled reader. The bayonet 2102 attachment ensures that the dispenser 2108 is securely locked into the lid 2106 but the spring 2104 will allow for relative movement between the dispenser 2108 and the lid 2106.

Figure 32A:
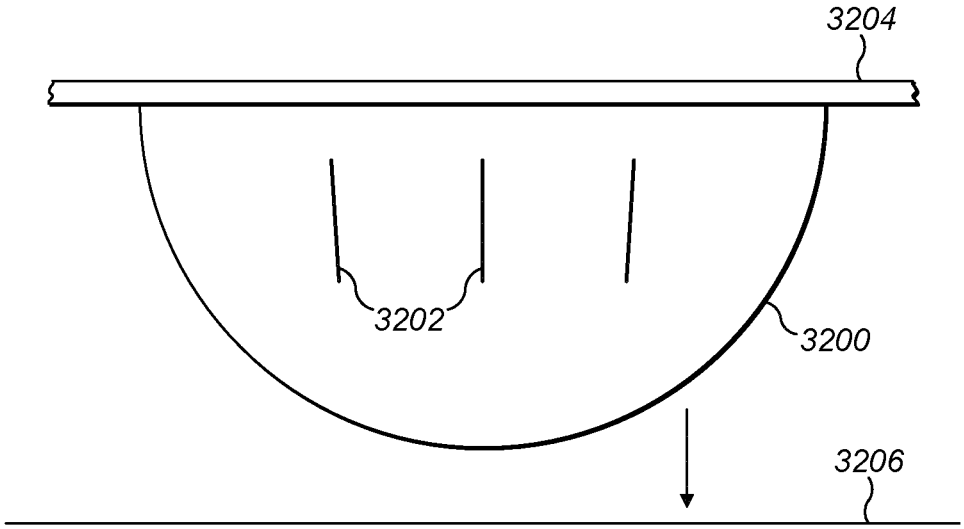
FIG. 32A shows a flexible dispenser for a waste storage device in an uncompressed state.
Figure 32B:
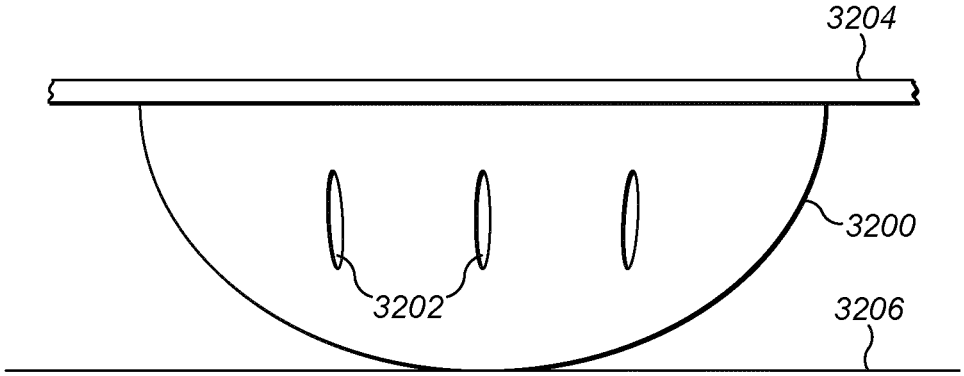
FIG. 32B shows the flexible dispenser of FIG. 32A in a compressed state.

The entire dispenser may be made from a non-rigid, flexible material so that the entire dispenser can deform in order to agitate powder therein and vent powder from the dispenser. For example, the dispenser may be dimensioned and positioned so that it collides with the main body of a waste storage device and/or with a waste cassette or cartridge stored therein when the lid to which the dispenser is attached closes. Such a collision would distort the dispenser in order to distribute the powder from therein. The vents or holes on the surface of the dispenser can be shaped so that powder cannot escape therethrough except when the dispenser is distorted. For example, the vent may be provided in two layers wherein the holes in each layer are not aligned with one another when the dispenser is in its undeformed state but do align with one another and thereby allow passage of powder therethrough when the dispenser is distorted FIGS. 32*a* and 32*b* show another possible flexible dispenser 3200. The vents 3202 therein are in the form of narrow slits in the wall of the flexible dispenser 3200. The dispenser 3200 is located on the under surface of the lid 3204 of a waste storage device and is arranged so that when the lid 3204 is in its closed position the dispenser 3204 collides with the main body 3206 of the waste storage device, thereby compressing the shape of the dispenser 3200. Alternatively the dispenser could compress upon collision with a projection somewhere on the device during opening or closing of the lid 3204. Such compression distorts the slit vents 3202, causing them to open to allow powder to be released. The slit vents are shown high up on the surface of the dispenser in FIGS. 32*a* and 32*b* but could be located anywhere on the dispenser, for example at the point of collision. They can also be of any appropriate length dependent on the dosing requirements for the powder or other agent inside the dispenser, bearing in mind that if the slit vents are too long they may not open sufficiently to dose out powder upon collision of the dispenser with the device.

Dosage of Powdered Agent from a Dispenser

Figure 22:
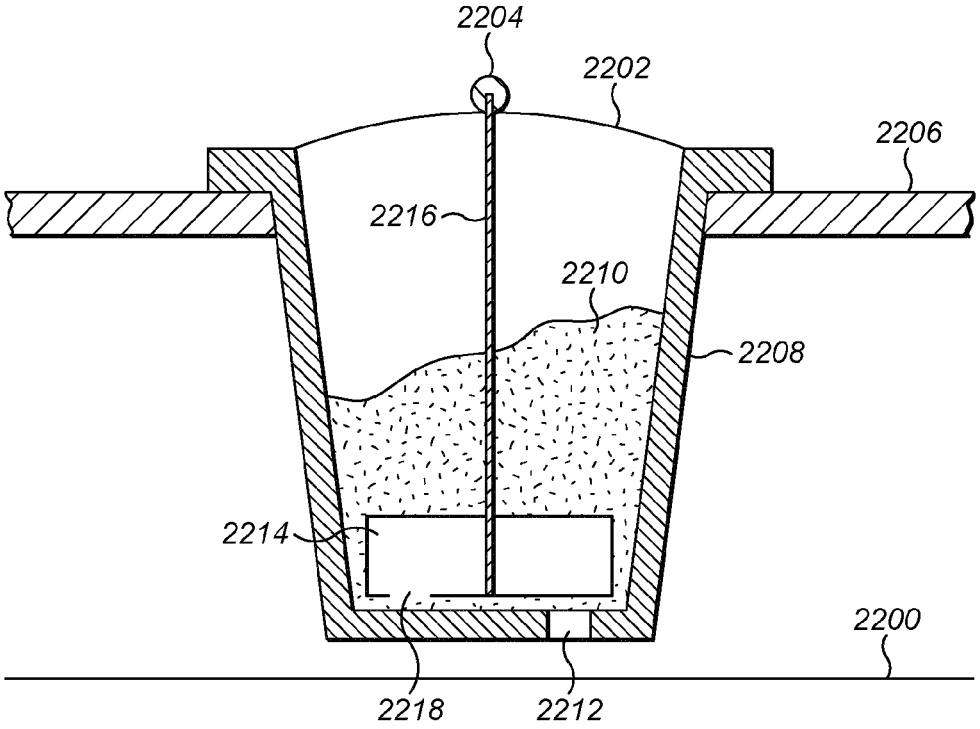
FIG. 22 shows a cross section of an upper portion of a waste storage device including a powder dispenser and dosing means.

In devices which make use of powdered antibacterial and/or anti odour agent, there is a potential risk of the powder being spilled or otherwise wasted at times during operation. It is therefore desirable to provide portion control for such devices. FIG. 22 shows one possible arrangement for achieving this.

The waste storage device 2200 therein includes a dispenser 2208 affixed to the lid 2206 of the device. As shown therein, there is a gap in the lid 2206 through which the dispenser 2208 is inserted, extending downwardly towards the main body of the waste storage device 2200. In the arrangement shown in FIG. 22 the dispenser 2208 engages with the lid 2206 via a push fit, however any suitable inter-engagement means may be used. The dispenser 2208 comprises a cap 2202 covering the substantially hollow body of the dispenser 2208. On an outer surface of the cap 2202 there is an actuator 2204. The actuator 2204 has a spindle 2216 extending downwardly therefrom, into the hollow body the dispenser 2208 underneath the lid 2206. The actuator 2204 can be used to rotate the spindle 2216 when the lid 2206 of the waste storage device is closed. The cap 2202 can be made from any suitable material and shape but ideally it should provide a tight but releasable fit with the gap or aperture in the lid 2206 so that the user can take the cap 2202 off to refill the dispenser. It should also fit closely to the spindle 2216 while still allowing the spindle 2216 to rotate.

At the distal end of the spindle 2216 there is a collector 2214 for collecting a portion of the powder 2210 that is stored in the dispenser 2208. In the arrangement shown in FIG. 22 the collector 2214 is disc-shaped when viewed from above, however, any suitable size and shape of collector 2214 may be used dependent on the size and shape of the dispenser 2208 and the size of the portion of powder that is to be distributed from the collector 2214. There is an opening 2218 in a portion of the base of the collector 2214. The opening 2218 may for example be one quarter of the disc-shape at the base of the collector 2214. There is a second opening 2212 in the lowermost surface of the dispenser 2208. In order for powder 2210 stored in the dispenser 2208 to be distributed therefrom, the opening 2218 at the base of the collector 2214 must be aligned with the opening 2212 at the base of the dispenser 2208. In practice this is achieved by rotating the collector 2214 about its central axis using the actuator 2204 and the spindle 2216.

A feedback mechanism may be provided so that the user knows, when actuating the actuator 2204, when the two openings 2218, 2212 are aligned. Further feedback, such as tactile feedback and/or an audible click, can be provided so that the user can further rotate the collector 2214 until the two openings 2218, 2212 are completely out of alignment with one another at times when the user does not want powder from the dispenser 2208 to be distributed via the openings to the waste storage device below. A locking mechanism may further be provided so that the collector 2214 is locked with its opening 2218 out of alignment with the opening 2212 in the dispenser 2208, so that movement such as actuation of the lid 2206, or the device 2200 being knocked or moved does not cause distribution of the powered agent 2210 from the dispenser 2208 accidentally.

The actuator 2204 as shown in FIG. 22 may be provided in a number of different forms. For example, it may comprise a rotatable handle wherein rotation of that handle imparts rotational movement onto the spindle 2216 and collector 2214. Markings may be provided on the rotatable handle to visually show the user when the collector 2214 is locked to prevent distribution of the powdered agent 2210 and when it is aligned so as to provide maximum distribution of the powdered agent 2210. Alternatively, the actuator 2204 may be depressible by the user in order to rotate the spindle 2216 and collector 2214. Such an arrangement requires a spring to translate the vertical depression of the actuator into rotational movement of the spindle 2216 and collector 2214. Mechanisms of this type are known.

The opening 2218, 2212 in the collector 2214 and dispenser 2208 respectively may comprise fully opened channels or may include a mesh or grid in order to filter and therefore further dose distribution of powder from the dispenser 2208 out into the main body of the waste storage device 2200. The opening 2212 in the base of the dispenser 2208 may be selected so that the powder is distributed onto a selected area within the waste storage device, for example onto the flexible tubing drawn out from a waste storage cassette or cartridge housed within the device. Additionally or alternatively, the dispenser itself may be rotatable about its central axis so that, when the openings 2218, 2212 are aligned, the dosed powder is not distributed only at one point but is instead distributed across a larger defined area within the waste storage device 2200.

Figure 23:
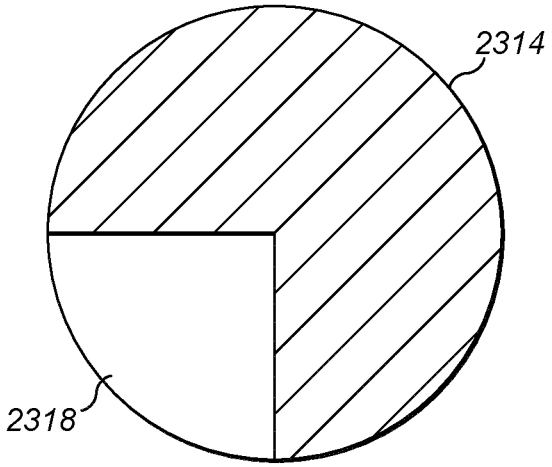
FIG. 23 shows a plan view of a possible dosing means for use with the device of FIG. 22.

The means for collecting a portion of powder inside a dispenser and dosing it out of the dispenser as shown in FIG. 22 must be closed over a sufficient area in order to cover the opening 2212 in the base of the dispenser 2208 at times when powder is not to be distributed out of the dispenser. In addition, it should comprise one or more open portions in order to allow passage of powder therethrough. For example, FIG. 23 shows a top view of a collector wherein the collector 2314 is circular in cross-section and wherein the opening 2318 in the base of the collector 2314 comprises one quarter of the circular cross-section. With such an arrangement, there is only one position of the collector 2314 for which the passage between the powder in the dispenser and the body of the waste storage device therebelow would be fully opened.

Figure 24:
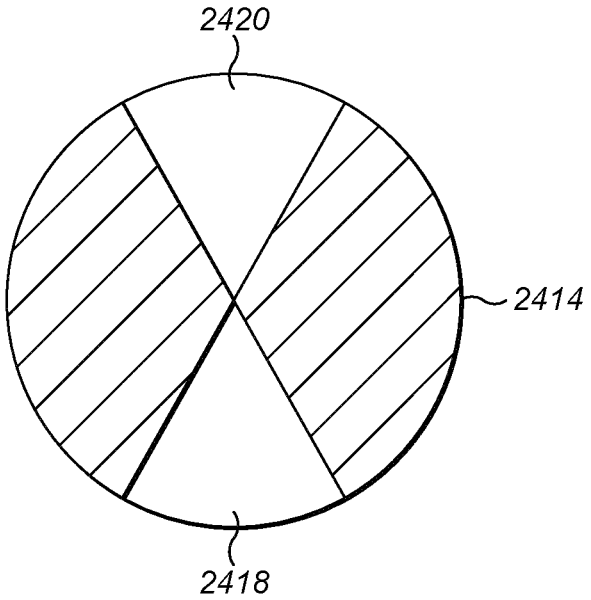
FIG. 24 shows a plan view of an alternative dosing means for use with the device of FIG. 22.

An alternative arrangement is shown in FIG. 24 wherein the collector 2414 comprises first 2418 and second 2420 open portions in its base. Therefore there are two rotational positions of this collector 2414 within a dispenser that provides a passageway from the powder in the dispenser to the waste storage device therebelow to be fully open. Of course, with any collector having an opening in its base, during rotation of the collector from a closed position to a fully open position it will go through a partially open state wherein some of the opening at the base of the collector is aligned with the opening at the base of the dispenser, thereby allowing some powder to pass therethrough.

Figure 25:
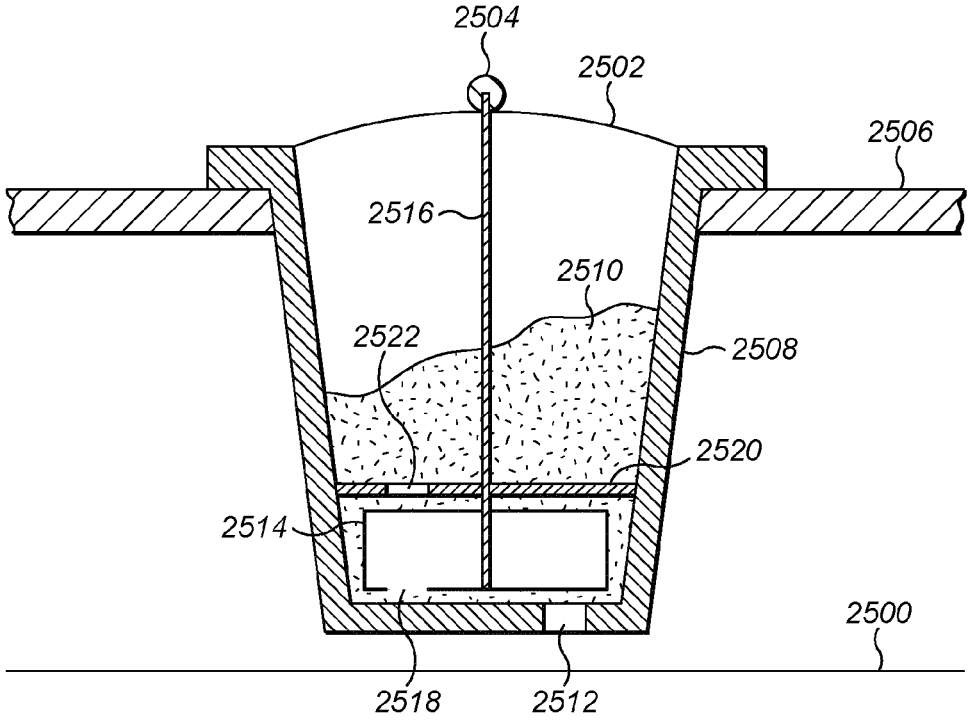
FIG. 25 shows a cross section of an upper portion of a waste storage device including a powder dispenser and dosing means.

FIG. 25 shows an arrangement including all the features described above with respect to FIG. 22 and an additional shelf 2520 provided in the dispenser 2508, just above the collector 2514. The shelf 2520 comprises an opening 2522 therein. That opening 2522 in the shelf 2520 is out of alignment with the opening 2512 at the base of the dispenser but it can align with the opening 2518 at the base of the collector 2514, as shown in FIG. 25. In such an arrangement, in order to fully lock the collector 2514, it must be rotated via the actuator 2504 and spindle 2516 so that the opening 2518 therein is out of alignment both with the opening 2522 in the shelf 2520 and the opening 2512 at the base of the dispenser 2508. This locking position would be achieved by rotating the collector 2514 90° from its position as shown in FIG. 25. In operation, rotation of the collector 2514 from a fully closed to a fully open state is a two stage process. In the first stage, the collector 2514 is rotated to align its opening 2518 with the opening 2522 in the shelf 2520, so that powder 2510 in the dispenser 2508 can fall through into the portion of the collector 2514 which has an opening at its base. As described in detail above, the powder 2510 can comprise an antibacterial and/or an anti odour agent. In the second stage of the process, the collector 2514 is rotated again in order to align the opening 2518 at its base with the opening 2512 in the base of the dispenser 2508. As a result, powder in the collector will drop through the base of the dispenser 2508 into the body of the waste storage device 2500 therebelow.

Figure 26:
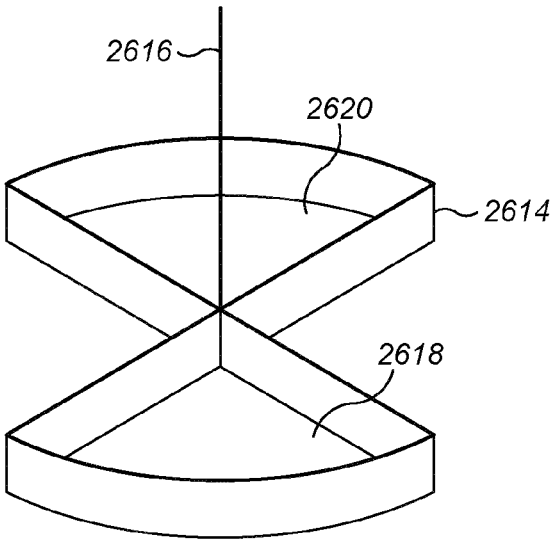
FIG. 26 shows an alternative dosing means for use with the device of FIG. 25.

In the arrangements shown in FIGS. 22-24, where a shelf was not provided above a collector in the dispenser, it was necessary for the collector to have a base including at least one closed portion, to cover the opening at the base of the dispenser. In an arrangement such as that shown in FIG. 25, with a shelf provided above the collector, there is no need for the collector to include any closed base portions since the shelf will effectively cover the opening at the base of the dispenser. FIG. 26 shows a possible collector 2614 of this type, comprising first 2618 and second 2620 collector portions, each having an open base, and no closed base portions. To lock such a collector 2614 the spindle 2616 should be rotated so that neither open collector portion 2618, 2620 is aligned with the opening at the base of the dispenser therebelow.

In each of the arrangements and alternatives described herein with respect to FIGS. 22-26, the collector should be arranged within the dispenser so that the base of the dispenser lies flush with, or at least very close to, the base of the dispenser. Such an alignment will ensure that little or no powder can escape through the opening in the base of the collector back into the body of the dispenser when the collector is in a locked position. The skilled reader will also appreciate that when the dispenser has at least enough powder therein in order to cover the collector, downward pressure of the powder will ensure that any powder which escapes out of the hole in the base of the collector when it is in a locked position will be replaced by more powder from the dispenser above the collector. To achieve this, the inside of the dispenser can include a marking to show the minimum fill level of powder therein. Because the size of the collector, and in particular the size of the open portion of the collector that will align with an opening at the base of the dispenser, is known, the amount of powder that will be dosed out of the dispenser each time the hole in the collector is aligned with the hole in the base of dispenser is also known. Therefore a controlled system for distributing powder comprising an antibacterial and/or an anti odour agent within a waste storage device is provided.

Instead of providing a collector with a partially opened base as described above in relation to FIGS. 22-26, alternative means may be provided in order to give a similar dosing effect. The collector 2514 shown in FIG. 25 can be replaced by a conduit that can be positioned to provide a flow path for powder from the opening 2522 in the shelf 2520 down to the opening 2512 in the base of the dispenser 2508 for powder distribution. The conduit can then be rotated to remove the path between the two openings and to provide a blockade therebetween. The conduit may comprise a corkscrew to provide a more controlled path for the powder, rather than having a direct point-to-point flow path between the two openings 2522, 2512. According to a further alternative, instead of rotating a collector to distribute powder out of a dispenser, linear movement of a plunger or other actuator can be used to push powder out of the dispenser. The plunger can be arranged to push a predetermined amount of powder out of the dispenser per actuation, hence providing a dosing effect. Alternatively, instead of rotating about a central vertical axis, a collector may be provided which rotates about a horizontal axis in order to empty a dosed amount of powder out of the dispenser. Such a collector would be open at the top end, as per the collector as described with respect to FIGS. 22-26, but need not have any opening in its base. Instead, in operation the collector would be rotated upside down to empty powder out of its top end through the opening in the base of the dispenser.

The collectors depicted in FIGS. 22-26 are substantially circular in cross-section. However any suitable cross-sectional shape of collector may be used. In addition, in the arrangements described above the opening is in the base of the dispenser. However, it is possible to provide an opening in the side of the dispenser. The collector may be actuated in a suitable manner in order to dispense powder out of the opening in the side of the dispenser. For example, an open bottomed portion of the collector may be slid or otherwise translated out of the slot at the side of the dispenser, in order to empty the powder therein onto the waste storage device therebelow.

As mentioned above, the dispenser itself may be rotatable or otherwise movable in order to increase the distribution area for the powder. The distribution area may be chosen so that powder comprising antibacterial and/or anti odour agent is distributed onto a selected portion of the waste storage device and/or onto a waste storage cassette or cartridge stored therein.

Improved Cartridge

An improved cartridge or waste storage cassette is provided herein.

Figure 27:
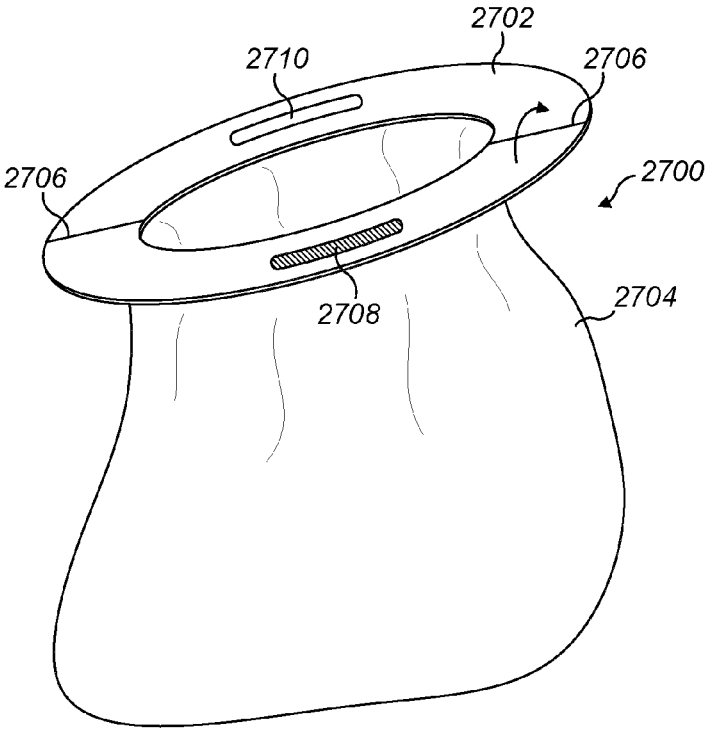
FIG. 27 (Prior Art)
FIG. 27 shows a known waste cartridge.

As well as waste storage cassettes of the type shown in FIG. 2 herein, which distribute a length of flexible tubing therefrom, folding cartridges are known for use with a waste storage device. An example of such a cartridge is shown in FIG. 27. The cartridge 2700 comprises a ring 2702 at its top end and a bag 2704 or length of tubing extending downwardly therefrom. The ring 2702 is relatively rigid whilst the bag 2704 or tubing is relatively flexible yet strong enough to hold a number of items of waste. In the example shown in FIG. 27, the ring comprises two folds or hinges 2706, positioned substantially diametrically opposite one another on the surface of the ring 2702 and each extending across the width of the ring 2702 at their respective locations. In use, the ring 2702 can be folded about these hinges 2706 to bring the two halves of the ring together and thereby close the top of the bag 2704. Any suitable means for enabling reliable closure of the ring 2702 may be provided. For example, in FIG. 27 a rib 2708 and cooperating recess 2710 are provided.

Figure 28:
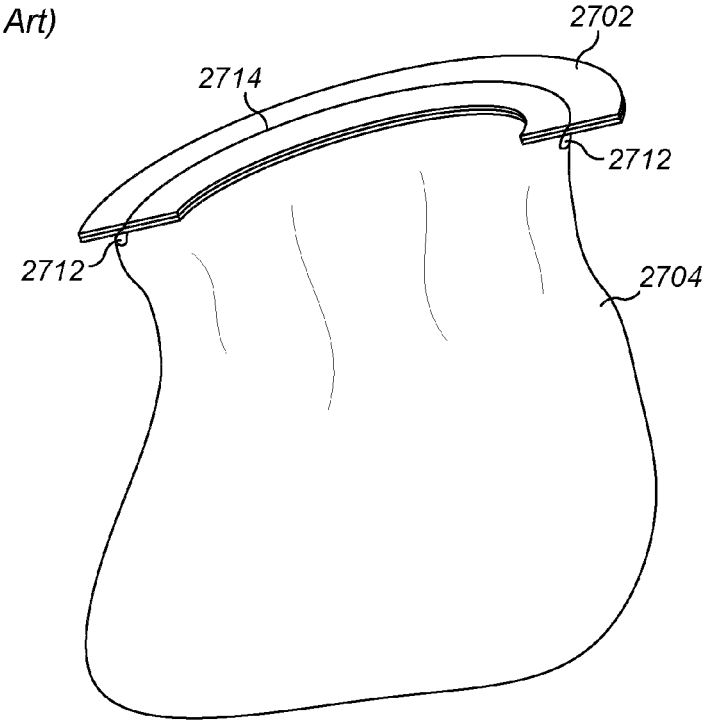
FIG. 28 (Prior Art)
FIG. 28 shows the waste cartridge of FIG. 27 in closed form.

In prior art cartridges such as the one shown in FIG. 27, the bag 2704 is generally welded to the underside of the ring 2702. In use, the ring is folded upwards in order to close the top of the bag. A problem with such an arrangement is that the weld cannot be continuous as it is not possible to weld the bag onto the hinge. As a result, when the ring is folded and sealed there is a small hole 2712 at either side of the folded ring, as shown in FIG. 28 herein. Such holes will allow odours from the bag to escape therethrough. This is a significant problem for users particularly when the cartridge 2700 is being used to store and dispose of waste such as used nappies or diapers. Furthermore, the weld 2714 between the bag 2704 and the underside of the ring 2702 in prior art arrangements must be sufficiently strong to withstand all the weight in the bag when it is filled. Because of this requirement, in prior art arrangements the weld 2714 must be located relatively near to the outer edge of the ring 2702, in order to increase the surface area, and hence the strength, of the weld 2714. The portion of the bag 2704 that is welded to the underside of the ring 2702 is effectively wasted, since it cannot be used to hold or wrap waste packages. Furthermore, in order for the ring 2702 in the prior art arrangements to close, the bag 2704 cannot be filled too much, hence again wasting bag material.

Figure 29:
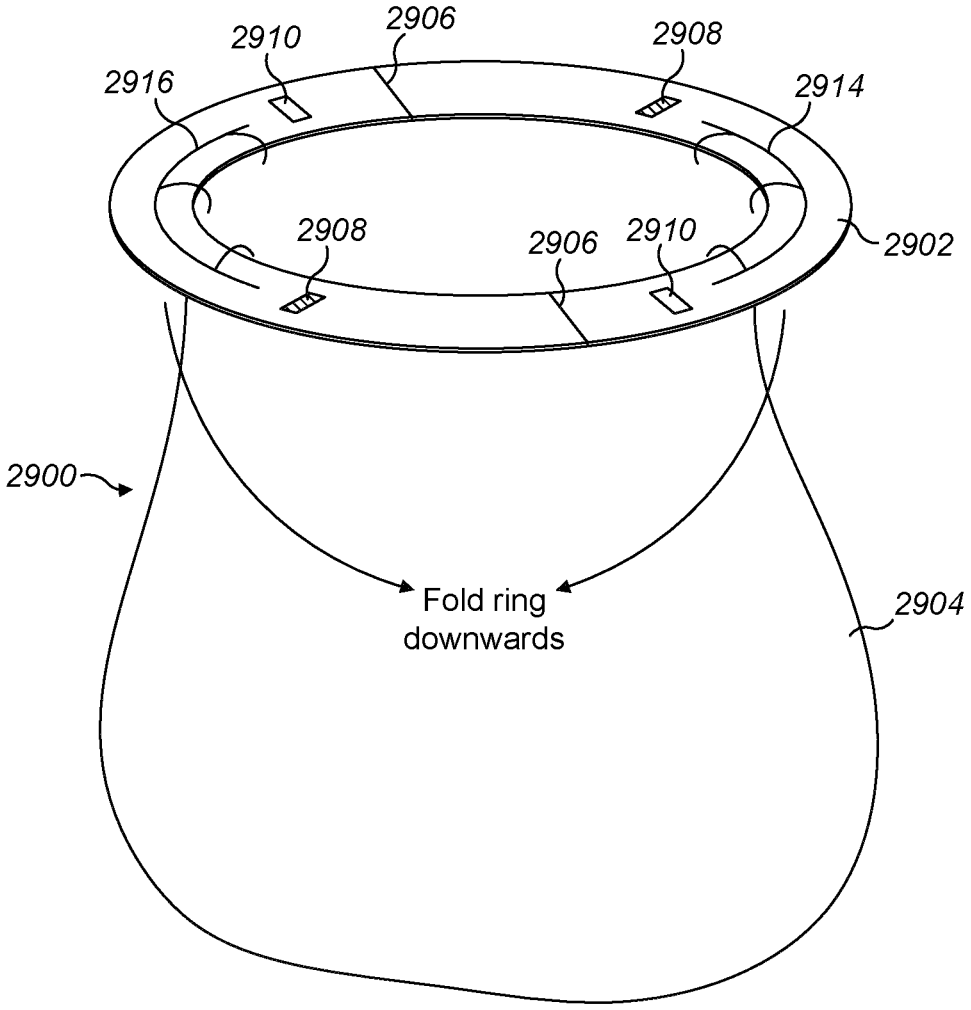
FIG. 29 shows an improved waste cartridge.

An improved waste cartridge is shown in FIG. 29. The cartridge 2900 comprises a relatively rigid ring 2902 at its upper end and a bag 2904 of relatively flexible material extending downwardly therefrom. As an alternative, instead of a closed bag, a length of open tubing that can be tied at its distal end may extend from the ring 2902.

The bag 2904 as shown in FIG. 29 is attached to an upper surface of the ring 2902. Preferably the bag 2904 attaches to the ring 2902 by welding. First 2914 and second 2916 welds are shown on the upper surface of the ring 2902 in FIG. 29. As can be seen therein, each weld 2914, 2916 extends only along a relatively small portion of a circumference on the upper surface of the ring 2902. In particular, the two welds 2914, 2916 do not extend in order to meet one another. Therefore the bag 2904 is only welded to the ring 2902 along part of its upper circumference. A significant portion of the top of the bag is not welded to the ring 2902 at all.

Folds or hinges 2906 are provided in the ring 2902. The hinges 2906 are positioned substantially diametrically opposite one another on the ring 2902, each extending across the width of the ring 2902 at their respective locations. In the cassette shown in FIG. 29, the hinges 2906 are positioned away from the weld 2914, 2916 on the upper surface of the ring 2902. Therefore, rather than providing a minimally small discontinuity in the weld in the vicinity of the hinges 2906, in the improved cartridge described herein there is a significant and deliberate discontinuity in the weld between the bag 2904 and the ring 2902, in order to leave a significant region unwelded around the hinges 2906.

Figure 30:
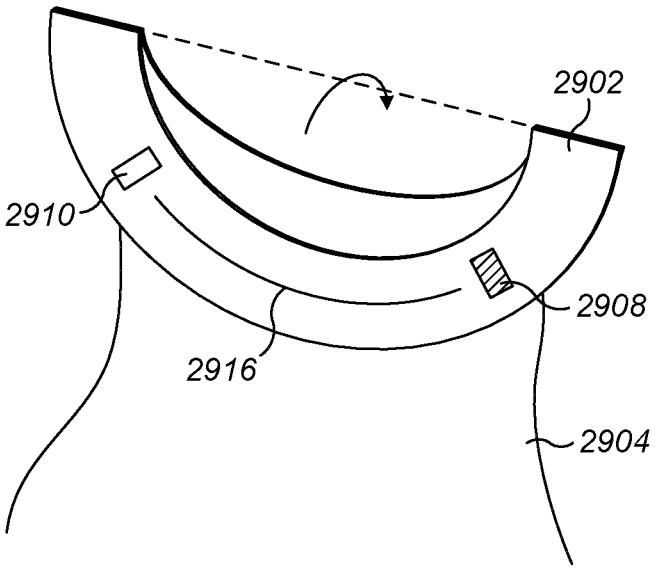
FIG. 30 shows the improved waste cartridge of FIG. 29 during folding.
Figure 31:
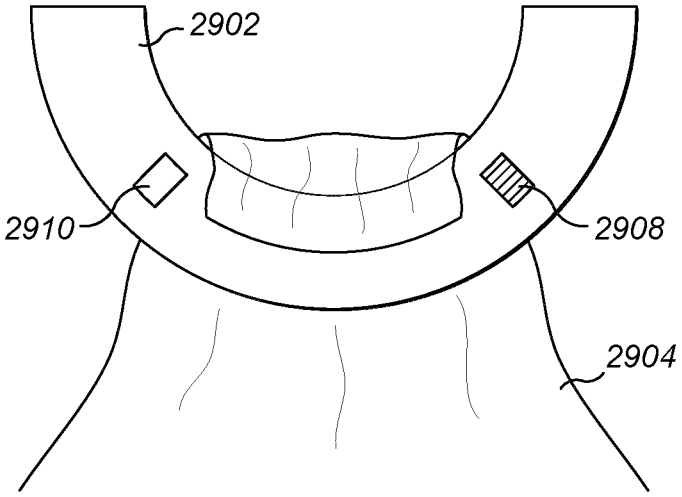
FIG. 31 shows the improved waste cartridge of FIG. 29 and FIG. 30 in a fully folded state.

The folds or hinges 2906 are arranged so that the ring 2902 is folded downwards in order to seal the top of the bag 2904 in the improved waste cartridge. This can be seen more clearly from FIGS. 30 and 31. Mechanical means for biasing a hinge in a certain direction are well known so will not be described in more detail herein. Because the bag is only welded to a portion of the ring well away from the hinges 2906, when the ring 2902 is folded downwards in this manner the top of the bag will naturally fall away from the hinge areas thereby not interfering with closure of the ring 2902.

A rib 2908 and recess 2910 arrangement is provided on either side of each hinge 2906 in the improved waste cartridge 2900. The rib 2908 and recess 2910 cooperate with one another so that, when the ring 2902 is folded about the hinges 2906, the rib 2908 inter-engages with the recess 2910 in order to firmly close the ring 2902. The rib 2908 and recess 2910 arrangements are provided on the under surface of the ring 2902, in the vicinity of the ends of the welds 2914, 2916 so that when the ring 2902 is folded downwards and the bag 2904 naturally falls away from the ring 2904 except in the welded regions, inter-engagement of the ribs 2908 and recesses 2910 effectively traps any loose portions of the bag at its upper end, therefore enhancing the seal provided by closure of the ring 2902. Although not shown in FIG. 29, it is also possible to provide an additional rib and recess arrangement in the vicinity of the weld in order to further enhance the closure of the ring 2902.

According to an alternative, there are no specific hinges or folds 2906 provided on the ring. Instead the ring simply comprises weakened regions which allow the ring to be bent by 0.180°. Also, although ribs and recesses are used in the cassette shown in FIG. 29 in order to enhance the sealing of the ring 2902 therein, it is possible to use alternative inter-engagement means such as any suitable pins, lugs or grooves which help to lock the two sides of the ring together in the folded state.

There are several advantages associated with the improved cartridge as discussed hereabove. Because the bag is only welded to the ring along a small portion of its surface and because the exact position of the weld does not determine the quality of the seal when the ring is folded, the welding process can be quicker. The welding will also be more cost-effective as there will be fewer rejected products because weld accuracy is not vital due to the fact that the final seal of the folded ring is achieved by the interengagement of ribs 2908 and recesses 2910. Also because the bag welds to an upper surface of the ring, the weld can be located closer to the inner edge of the ring, thereby requiring a smaller surface area of bag to be welded to the ring. This cuts down on wasted plastic and again makes the welding process quicker and more cost-effective.

Because the bag is only welded to the ring along two limited portions of its surface, and can therefore naturally fall away from the ring when it is folded, the bag can be filled with waste to quite a high level without causing stress on the weld regions with closure of the ring.

Because the bag can be filled to a high level before the ring at the top must be closed, the improved cartridge can hold more waste than prior art cartridges and therefore needs to be replaced less often. Thus, it is more convenient and cost-effective for the user. When the ring is closed in order to seal the top of the bag, there are no gaps or holes through which odour can escape. Instead, the material of the bag is tightly pressed together by either side of the ring coming together and by the rib and recess or other arrangement provided to trap the bag material away from the hinges on the ring. The user can ensure this happens by tucking any loose portions of the top of the bag into the trapping arrangement whilst they are folding the ring. Therefore, a hygienic and odour-free waste storage system can be provided.

The improved waste cartridge can be used in conjunction with a variety of waste storage devices. For example, it may be used in conjunction with a waste storage device comprising a gripping means for gripping a portion of the bag below the ring, in order to seal the bag temporarily between successive deposits of waste packages therein. Alternatively or additionally the improved cartridge may be used in conjunction with a waste storage device that twists a portion of the bag in order to provide a barrier between a stored waste package and the next waste package that is to be inserted into the bag.

The ring and bag may be formed of any suitable material, including recycled material, such as plastic. The material may be bio-degradable. The bag and/or the ring may be impregnated with antibacterial and/or anti odour agent in order to further improve its operation.

Hence, an improved waste storage device and an improved cartridge are provided. Whilst the waste storage device and cartridge have been described herein for use in disposing of used nappies or diapers, it will be appreciated that they can be used for storage of any waste material. Although not described herein, accumulated waste material may be removed from a waste storage device in any suitable manner for example using an opening at the base of the waste storage device and/or by separating upper and lower portions of the device from one another and removing the bag or tubing with accumulated waste therein from the device.

Whilst particular embodiments and examples have been shown and described herein, it will be appreciated that other variants are possible without departing from the scope of the invention as set out in the appended claims.

The invention claimed is:

1. A waste storage device comprising;

a waste storage compartment for storing waste;

a lid;

the device further comprising a dispenser having a cavity for storing and dispensing an agent in powder form inside the waste storage device, said dispenser having an inner surface and an outer surface with at least one hole extending from the inner surface to the outer surface;

an actuator arranged to activate the dispenser, said actuator having a moveable top wall, the top wall has a top surface being in communication with air exterior to the cavity and moveable from a first position to a second position, and the top wall having a bottom surface being in communication with air inside the cavity; and wherein movement of the top surface of the actuator from the first position to the second position displaces air in direct contact with the bottom surface into the agent in the cavity to cause a dose of the agent to travel through the hole.

2. A waste storage device as claimed in claim 1 wherein the dispenser is arranged to dispense at least one of an anti-bacterial agent and an anti-odour agent.

3. A waste storage device as claimed in claim 1 wherein the actuator is arranged to activate the dispenser when the lid of the device is in a closed position.

4. A waste storage device as claimed in claim 1 wherein said actuator includes a projection extending from an inner surface of the lid.

5. A waste storage device as claimed in claim 1 wherein the actuator is arranged to direct an air flow into the agent stored in the dispenser.

6. A waste storage device as claimed in claim 1 wherein the actuator is arranged to direct an air flow over the agent stored in the dispenser.

7. A waste storage device as claimed in claim 1 wherein the dispenser is attachable to an inner surface of the lid.

8. A waste storage device as claimed in claim 7 wherein at least one opening is provided in a surface of the dispenser, said opening being located so that actuation of the lid does not cause agent to be dispensed from the dispenser.

* * * * *